US012781589B2

(12) United States Patent
Zakharia et al.

(10) Patent No.: US 12,781,589 B2
(45) Date of Patent: Nov. 3, 2026

(54) INITIATOR SYSTEM PROVIDING SET CONFIRMATION FROM PLUG SETTING TOOL IN DOWNHOLE WELL

(71) Applicant: G&H Diversified Manufacturing, LP, Houston, TX (US)

(72) Inventors: Steven Zakharia, Houston, TX (US); Ryan Ward, Tomball, TX (US); Adam Green, Houston, TX (US); Charles Levine, Houston, TX (US); Benjamin Knight, Katy, TX (US); Joe Noel Wells, Lindale, TX (US); Timmothy Alain Lee, Tomball, TX (US); William Caruana, Cypress, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 19/287,386

(22) Filed: Jul. 31, 2025

(65) Prior Publication Data

US 2025/0361784 A1 Nov. 27, 2025

Related U.S. Application Data

(63) Continuation of application No. 18/732,770, filed on Jun. 4, 2024, now Pat. No. 12,392,216, which is a (Continued)

(51) Int. Cl.
*E21B 33/13* (2006.01)
*E21B 23/04* (2006.01)

(52) U.S. Cl.
CPC ..... *E21B 33/13* (2013.01); *E21B 23/04* (2013.01)

(58) Field of Classification Search
CPC ..... E21B 33/13; E21B 23/04; E21B 23/065
See application file for complete search history.

(56) References Cited

U.S. PATENT DOCUMENTS 3,246,707 A * 4/1966 Bell ..... E21B 43/117 175/4.54
3,264,994 A * 8/1966 Leutwyler ..... E21B 47/13 166/63

(Continued)

FOREIGN PATENT DOCUMENTS

WO WO-2018227199 A1 * 12/2018 ..... E21B 17/06

*Primary Examiner* — Steven A Macdonald
(74) *Attorney, Agent, or Firm* — Conley Rose, P.C.

(57) ABSTRACT

A system for setting a plug in a wellbore includes a setting tool configured, upon activation, to displace the shift the plug in the wellbore from a run-in configuration permitting fluid flow within the wellbore around the plug to a set configuration restricting fluid flow in the wellbore around the plug, an initiator including an igniter switch and an igniter assembly including an igniter energetic element, the initiator including a signal interrupter configured to shift automatically from a first state in which signal communication is provided through the signal interrupter between the igniter switch and the igniter assembly to a second state in which signal communication is restricted through the signal interrupter between the igniter switch and the igniter assembly in response to exposing the initiator to a predefined toolstring condition and whereby a surface indication is provided of the shifting of the plug to the set configuration.

20 Claims, 16 Drawing Sheets

Related U.S. Application Data continuation-in-part of application No. 18/610,952, filed on Mar. 20, 2024, now Pat. No. 12,404,739, which is a continuation of application No. 17/742,185, filed on May 11, 2022, now Pat. No. 11,965,393.

(60) Provisional application No. 63/187,145, filed on May 11, 2021.

(56) References Cited

U.S. PATENT DOCUMENTS 3,414,071 A * 12/1968 Alberts ..... E21B 33/13 166/185
4,100,978 A * 7/1978 Boop ..... E21B 43/1185 102/306
5,052,489 A * 10/1991 Carisella ..... F42D 1/04 337/145
6,035,880 A * 3/2000 Gazda ..... E21B 21/103 137/68.16
9,810,035 B1 * 11/2017 Carr ..... E21B 23/065
10,036,236 B1 * 7/2018 Sullivan ..... E21B 43/11855
10,900,334 B2 * 1/2021 Knight ..... E21B 43/1185
10,900,335 B2 * 1/2021 Knight ..... F42D 1/05
10,920,544 B2 * 2/2021 Sullivan ..... E21B 43/1185
11,236,591 B2 * 2/2022 Knight ..... E21B 43/119
11,708,731 B2 * 7/2023 Zakharia ..... E21B 33/134 166/387
2005/0022987 A1 * 2/2005 Green ..... E21B 47/24 166/250.17
2007/0125540 A1 * 6/2007 Gerez ..... F42D 1/045 166/55
2010/0085210 A1 * 4/2010 Bonavides ..... E21B 43/11 340/853.2
2017/0175472 A1 * 6/2017 Carisella ..... E21B 27/02
2018/0202249 A1 * 7/2018 Harrington ..... E21B 41/0085
2018/0371859 A1 * 12/2018 Tøndel ..... E21B 36/008
2019/0162057 A1 * 5/2019 Montoya Ashton ..... E21B 43/1185
2020/0225014 A1 * 7/2020 Maxted ..... E21B 43/1185
2020/0256166 A1 * 8/2020 Knight ..... E21B 43/1185
2020/0256168 A1 * 8/2020 Knight ..... E21B 43/1185
2021/0180434 A1 * 6/2021 Knight ..... E21B 23/065
2022/0127937 A1 * 4/2022 Knight ..... E21B 43/119
2022/0282585 A1 * 9/2022 Zakharia ..... E21B 33/1292
2023/0287748 A1 * 9/2023 Massey ..... E21B 23/0414
2024/0209704 A1 * 6/2024 Morrison ..... E21B 23/065
2025/0027390 A1 * 1/2025 Hoelscher ..... E21B 43/1185

* cited by examiner

INITIATOR SYSTEM PROVIDING SET CONFIRMATION FROM PLUG SETTING TOOL IN DOWNHOLE WELL

CROSS-REFERENCE TO RELATED APPLICATIONS

This application is a continuation of U.S. non-provisional patent application Ser. No. 18/732,770 filed Jun. 4, 2024, entitled "Initiator System Providing Set-Confirmation from Plug Setting Tool in Downhole Well", which is a continuation-in-part of U.S. non-provisional patent application Ser. No. 18/610,952 filed Mar. 20, 2024, and entitled "Downhole Setting Assembly with Switch Module", which is a continuation of US non-provisional patent application No. 17/742,185 filed May 11, 2022, and entitled "Downhole Setting Assembly with Switch Module", now U.S. Pat. No. 11,965,393, issued Apr. 23, 2024, which claims benefit of U.S. provisional patent application 63/187,145 filed May 11, 2021, and entitled "Downhole Setting Assembly with Switch Module", each of which are incorporated herein by reference in their entirety.

STATEMENT REGARDING FEDERALLY SPONSORED RESEARCH OR DEVELOPMENT

Not applicable.

BACKGROUND

During completion operations for a subterranean hydrocarbon wellbore, it is conventional practice to perforate the wellbore with perforating guns along with any casing tubulars disposed therein along a targeted hydrocarbon bearing formation such that the perforations will provide a path for formation fluids (e.g., hydrocarbons) to flow into the wellbore. To enhance the productivity of each of typically a great many perforations, the wellbore is divided into a plurality of production zones along the targeted formation where the perforations associated with each zone are enlarged and expanded by hydraulic fracturing sometimes referred to as "fracking". Each production zone is isolated from the next lower downhole zones by installing a frac plug or similar device into the wellbore along with a setting tool at the bottom end of a string or series of perforating guns. Once this tool string is positioned at the designated zone, the plug is set and then the perforating guns are sequentially fired to create the perforations as the string is drawn back toward the surface. With that, the tool string is pulled completely out of the wellbore for the hydraulic fracking system to then connect and pressure up to frack the newest perforations. Once fracking is complete, the process repeats with a new tool string of perforating guns, setting tool and frac plug.

Typically, the string is arranged with the plug attached at the downhole end with a setting tool arrangement arranged to push against the outer periphery of the plug at the top end thereof while also pulling upwardly on a plug mandrel that extends to the bottom of the plug such that the setting tool may squeeze the top and bottom ends together forcing the sealing elements on the plug to spread out and seal against the inside of the casing. The power for setting tool is provided by an energetic device that when ignited provides a large volume of gas that is typically hot combustion gases that pressurizes an internal void space like a cylinder to drive a piston like component that strokes within the setting tool and sets the frac plug.

As the setting tool is powering the setting of the plug, shear pins holding the setting tool to the plug are subjected to forces that eventually break the setting tool from the plug leaving the plug in place until removed at a later time in a separate operation. The firing head or setting tool initiator is attached at or near the top of the setting tool and includes a switch that is connected through the tool string and wireline cable to a controller at the surface. The switch in the firing head controls electric power access to an igniter that is arranged to ignite a power charge within the setting tool.

One concern with running tool strings with plugs and perforating guns is that the plug must be fully set before any perforations are punched in the casing above or uphole from the intended location of the plug. Not only is it critical that the plug be properly set, it is very helpful to those developing the well that the setting of the plug be confirmed before the perforating guns are fired. Recognizing that the operator at the surface has a high need to know that the sealing device is fully set and sealing off the downhole zones of the wellbore, the wireline operator can attempt to confirm that the plug has set by slowly reeling in wireline on to the wireline truck while the plug is being set and looking at the tension on the wireline cable at the surface expecting to see a slow increase in tension followed by a sudden drop in tension when the shear pins have disconnected the setting tool from the well anchored plug. If that characteristic tension change in the wireline cable is not observed, then the operator may pump additional fluid downhole and see if more wireline is drawn out with little increase in wellbore pressure which would suggest that the plug has not yet set. Conversely, if the plug has been fully set, any further liquid pumping would not push the sealing device farther downhole and wellbore pressure would increase. While these verification techniques provide some degree of confidence, they are time consuming in an operation where every additional minute results in added costs. Thus, the industry would value a better, faster, cheaper means for confirming that the plug has set before creating more perforations in a wellbore.

SUMMARY OF THE DISCLOSURE

An embodiment of a system for setting a plug in a wellbore comprises a setting tool connectable to the plug and comprising a housing, a piston positioned at least partially within the housing, and a setting tool energetic element configured, upon activation, to displace the piston axially relative to the housing and shift the plug in the wellbore from a run-in configuration permitting fluid flow within the wellbore around the plug to a set configuration restricting fluid flow in the wellbore around the plug, an initiator comprising an igniter switch and an igniter assembly in signal communication with the igniter switch, wherein the igniter assembly includes an igniter energetic element configured to activate, in response to receiving an ignition signal from the igniter switch, and thereby activate the setting tool energetic element to shift the plug from the run-in configuration to the set configuration, and wherein the initiator comprises a signal interrupter connected between the igniter switch and the igniter assembly and configured to shift automatically from a first state in which signal communication is provided through the signal interrupter between the igniter switch and the igniter assembly to a second state in which signal communication is restricted through the signal interrupter between the igniter switch and the igniter assembly in response to exposing the initiator to a predefined toolstring condition and whereby a surface indication is provided of the shifting of the plug to the set configuration. In some embodiments, the toolstring condition is based on an anticipated toolstring condition associated with at least one of the activations of the igniter energetic element and the setting tool energetic element. In some embodiments, the toolstring condition comprises a threshold wellbore temperature and the anticipated toolstring condition comprises at least one of a first anticipated toolstring temperature associated with the activation of the igniter energetic element, and a second anticipated toolstring temperature different from the first anticipated toolstring temperature and that is associated with the activation of the setting tool energetic element. In certain embodiments, the toolstring condition comprises at least one of a threshold toolstring pressure, a threshold toolstring temperature, a threshold toolstring force, and a threshold toolstring acceleration. In certain embodiments, the system comprises the plug connected to a downhole end of the setting tool. In some embodiments, the system comprises a surface control system is configured to deliver the ignition signal along an enclosed signal communication path to the igniter switch to cause the igniter switch to deliver the ignition signal to the igniter, wherein the signal communication path is arranged to provide two way signal communication between the surface control system and the igniter switch when the igniter switch is positioned in the wellbore. In some embodiments, the second state of the signal interrupter does not permit electric power or electric signals to pass to the igniter assembly from the igniter switch. In certain embodiments, the first state of the signal interrupter comprises a communicative state and the second state of the signal interrupter comprises a noncommunicative state. In certain embodiments, the igniter assembly includes an activator configured to ignite the igniter energetic element and that is in signal communication with the igniter switch when the signal interrupter is in the first state, and wherein the activator is exposed to combustion products generated from the activation of the igniter energetic element whereby the activator is disconnected from the igniter switch. In some embodiments, the activator comprises an electrical heat resistor. In some embodiments, the signal interrupter comprises an electrical circuit breaker electrically connected to the igniter switch and the igniter assembly when in the first state and electrically disconnected from the igniter switch when in the second state. In certain embodiments, the circuit breaker is configured to remain in the first state until exposed to combustion products from the activation of at least one of the igniter energetic element and the setting tool energetic element. In certain embodiments, the igniter switch is sealed from the igniter assembly when the signal interrupter is in both the first state and the second state.

An embodiment of a system for setting a plug in a wellbore comprises a setting tool connectable to the plug and comprising a housing, a piston positioned at least partially within the housing, and a setting tool energetic element configured, upon activation, to displace the piston axially relative to the housing and shift the plug in the wellbore from a run-in configuration permitting fluid flow within the wellbore around the plug to a set configuration restricting fluid flow in the wellbore around the plug, an initiator comprising an igniter assembly and an igniter switch in signal communication with and sealed from the igniter switch, wherein the igniter assembly includes an igniter energetic element configured to activate, in response to receiving an ignition signal from the igniter switch, and thereby activate the setting tool energetic element to shift the plug from the run-in configuration to the set configuration, and a surface control system in signal communication with the initiator and configured to transmit the ignition signal to the igniter switch, and to provide a surface indication of the shifting of the plug from the run-in configuration to the set configuration with the igniter switch remaining sealed from the igniter assembly. In some embodiments, the initiator is configured to shift automatically from a first state in which signal communication is provided between the igniter switch and the igniter assembly to a second state in which signal communication is restricted between the igniter switch and the igniter assembly in response to exposing the initiator to a predefined toolstring condition. In some embodiments, the igniter switch is in signal communication with the surface control system when the initiator is in both the first state and the second state. In certain embodiments, the igniter assembly is not in signal communication with the surface control system when the initiator is in the second state. In certain embodiments, the toolstring condition comprises at least one of a threshold toolstring pressure, a threshold toolstring temperature, a threshold toolstring force, and a threshold toolstring acceleration. In some embodiments, the system comprises an enclosed signal communication path extending between the surface control system and the initiator and arranged to provide two way signal communication between the surface control system and the igniter switch when the igniter switch is positioned in the wellbore. In some embodiments, the signal communication path comprises an electrical circuit. In certain embodiments, the surface indication corresponds to a disconnection of the igniter assembly from the signal communication path.

An embodiment of a system for setting a plug in a wellbore comprises a setting tool connectable to the plug and comprising a housing, a piston positioned at least partially within the housing, and a setting tool energetic element configured, upon activation, to displace the piston axially relative to the housing and shift the plug in the wellbore from a run-in configuration permitting fluid flow within the wellbore around the plug to a set configuration restricting fluid flow in the wellbore around the plug, an initiator comprising an igniter switch and an igniter assembly in signal communication with the igniter switch, wherein the igniter assembly includes an igniter energetic element configured to activate, in response to receiving an ignition signal from the igniter switch, and thereby activate the setting tool energetic element to shift the plug from the run-in configuration to the set configuration, and wherein the initiator comprises an electrical circuit breaker electrically connected between the igniter switch and the igniter assembly and configured to shift automatically from a first state in which electrical signal communication is provided through the circuit breaker between the igniter switch and the igniter assembly to a second state in which electrical signal communication is restricted through the signal interrupter between the igniter switch and the igniter assembly in response to shifting the plug from the run-in configuration to the set configuration and whereby a surface indication is provided of the shifting of the plug to the set configuration. In certain embodiments, the igniter assembly includes an activator configured to ignite the igniter energetic element and that is in signal communication with the igniter switch when the circuit breaker is in the first state, and wherein the activator is exposed to combustion products generated from the activation of the igniter energetic element whereby the activator is disconnected from the igniter switch. In some embodiments, the circuit breaker is configured to remain in the first state until exposed to combustion products from the activation of at least one of the igniter energetic element and the setting tool energetic element. In some embodiments, he system comprises a surface control system is configured to deliver the ignition signal along an electrical circuit to the igniter switch to cause the igniter switch to deliver the ignition signal to the igniter assembly, wherein the electrical circuit is arranged to provide two way electrical signal communication between the surface control system and the igniter switch when the igniter switch is positioned in the wellbore.

BRIEF DESCRIPTION OF THE DRAWINGS

A more complete understanding of the present disclosure may be obtained from the following detailed description with reference to the attached drawing figures as summarized below, in which.

DETAILED DESCRIPTION

Figure 1:
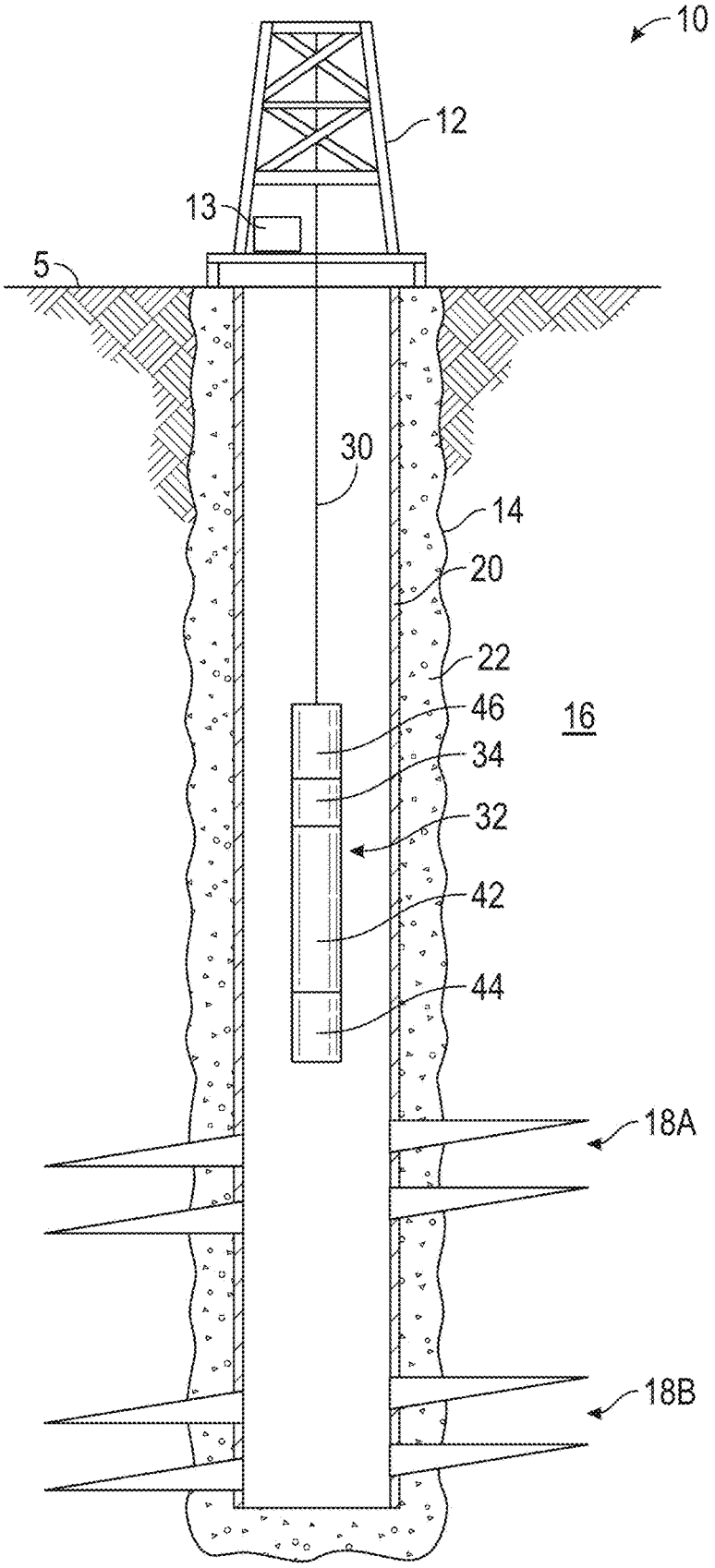
FIG. 1 is a schematic elevation view of a system for completing a subterranean well.

The following discussion is directed to various exemplary embodiments of the present disclosure. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

As it relates to setting tools "burning" or "firing" means the chemical reaction within the combustible element or energetic charge which results in the creation of gaseous combustion products and increasing pressure increase within a combustion compartment of the setting tool. Sometimes the terms "initiate" and "ignite" are used to describe the onset of the generation of gaseous pressure. The terms "burning", "igniting," or "firing", all describe the generation of gaseous pressure by the burning of the combustible element.

Figure 2:
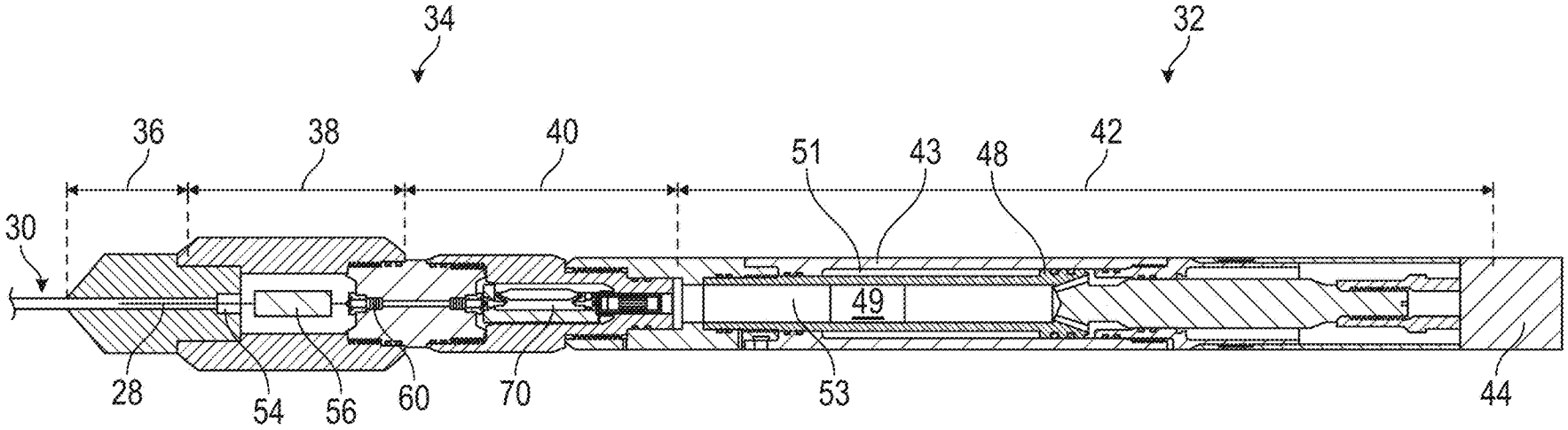
FIG. 2 is a cross-sectional view of an embodiment of a tool string for completing a subterranean well.

Referring now to FIGS. 1 and 2, an embodiment of a system 10 for plugging a wellbore 14 extending from the surface 5 through a subterranean earthen formation 16 is shown. In this exemplary embodiment, plugging system 10 generally includes a surface assembly or servicing rig 12 positioned at the surface 5 that extends over and around the wellbore 14 that penetrates the earthen formation 16 for the purpose of recovering hydrocarbons from a first production zone 18A and a second production zone 18B (collectively the production zones "18"). The wellbore 14 can be drilled into the subterranean formation 16 using any suitable drilling technique. While shown as extending vertically from the surface in FIG. 1, the wellbore 14 can also be deviated, horizontal, and/or curved over at least some portions of the wellbore 14. For example, the wellbore 14, or a lateral wellbore drilled off of the wellbore 14, may deviate and remain within one of the production zones 18. The wellbore 14 can be cased, open hole, contain tubing, and can generally be made up of a hole in the ground having a variety of shapes and/or geometries as is known to those of skill in the art. In the illustrated embodiment, a casing 20 can be placed in the wellbore 14 and secured at least in part by cement 22.

The servicing rig 12 of plugging system 10 can be one of a drilling rig, a completion rig, a workover rig, a wireline surface system, or other structure and supports a tool string 32 disposed in the wellbore 14. Servicing rig 12 includes a surface controller 13 in signal communication with one or more downhole tools of tool string 32. In other embodiments, other surface systems or structures can also support the tool string 32. The servicing rig 12 can also comprise a derrick with a rig floor through which the tool string 32 extends downward from the servicing rig 12 into the wellbore 14. It is understood that other mechanical mechanisms, not shown, can control the run-in and withdrawal of the tool string 32 in the wellbore 14.

In this exemplary embodiment, the tool string 32 generally includes a work string 30, a perforating gun 46 (hidden from view in FIG. 2), a signal sub 34, a setting tool initiator 40, a setting tool 42, and an auxiliary tool 44. It may be understood that in other embodiments the configuration of tool string 32 may vary. For example, in some embodiments, tool string 32 may additionally include a fishneck, one or more weight bars, a release tool, and/or one or more other downhole tools. The work string 30 can be any of a string of jointed pipes, a slickline, a coiled tubing, and a wireline. The tool string 32 can be lowered into the wellbore 14 to position the setting tool 42 to set or actuate a frac plug at a predetermined depth.

As shown particularly in FIG. 2, in this exemplary embodiment, setting tool 42 generally includes a setting tool housing 43, a piston 48 slidably disposed in the housing 43, and a combustible or explosive element 49 positioned in the setting tool housing 43. Particularly, setting tool housing 43 defines a central passage 51 having a combustion compartment 53 in which the combustible element 49 is received. Piston 48 is configured to impart a setting force against the auxiliary tool 44 in response to combustion of the combustible element 49. While the setting tool initiator 40 is described herein as separate from the setting tool 42, it may be understood that in some embodiments the setting tool initiator 40 may comprise a component of the setting tool 42 with the initiator housing comprising a section (e.g., a section housing) of the setting tool housing 43.

Auxiliary tool 44 is releasably attached to a distal or downhole end of the setting tool 42. In this exemplary embodiment, the signal sub 34 includes any combination of a cable head 36, and an instrument sub 38. The cable head 36 attaches the signal sub 34 to a work string 30 that includes an electrical conductor 28. For example, a wireline can include one or more electrical conductors wrapped with a braided wire. The cable head 36 can electrically connect the one or more electrical conductors 28 to another component of the signal sub 34 as will be described herein. The perforating gun includes one or more explosive shaped charges configured to perforate casing 20 at the desired location in response to receiving, by a gun switch of the perforating gun, a firing signal from the surface controller 13. It may be understood that while only a single perforating gun 46 is shown in FIG. 1, in other embodiments, tool string 32 may include more than one perforating gun 46.

In this exemplary embodiment, signal sub 34 of tool string 32 includes an instrument sub 38 with environmental sensors 56. The instrument sub 38 couples to the cable head 36 with an electrical connection 54. The environmental sensors 56 can include pressure and temperature sensors to measure the pressure and temperature of the wellbore environment, the pressure and temperature of the interior of the instrument sub, or a combination of both. The environmental sensor 56 can include a motion sensor that can be one or more accelerometers. The measurements of the accelerometers can indicate motion of the setting tool 42. The environmental sensor 56 can include a magnetic sensor commonly referred to as a collar locator used to indicate the location of the setting tool initiator within the wellbore 14. In some embodiments, the environmental sensor 56, of instrument sub 38 may only comprise the magnetic sensor. In some embodiments, other components of the tool string 32 such as perforating gun 46 may be positioned between the instrument sub 38 and setting tool 42.

The setting tool initiator 40 may connect to the signal sub 34 with an electrical connector sub 60 configured to provide a sealed electrical connection between the setting tool initiator 40 and the signal sub 34. The upper sealed electrical connection 60 electrically couples the setting tool initiator 40 to the electrical conductors 28 in the work string 30. The upper sealed electrical connection 60 can also provide pressure isolation between the setting tool initiator 40 and components of tool string 32 positioned uphole from setting tool initiator 40 such as, for example, perforating gun 46.

Figure 3:
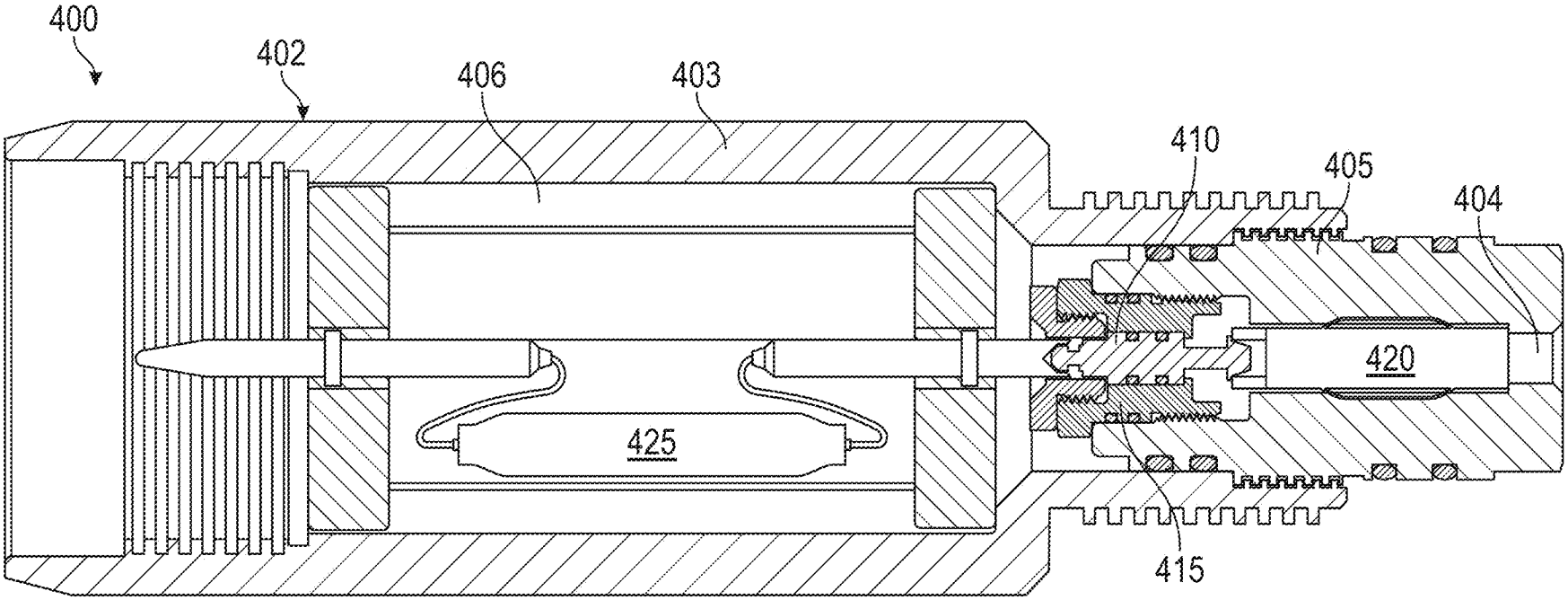
FIG. 3 (Prior Art)
FIG. 3 is a partial cross-sectional view of a conventional setting tool initiator for activating a setting tool.

Turning now to FIG. 3, a conventional setting tool initiator 400 is shown. Setting tool initiator 400 generally includes an initiator housing 402, an igniter 420, and a setting tool igniter switch 425. Initiator housing 402 is shown as including a pair of housing sections 403 and 405 which are connected together to form initiator housing 402. However, it may be understood that initiator housing 402 may comprise only a single housing or more than two housings. Initiator housing 402 defines an internal igniter compartment 404 and an internal switch compartment 406 within the housing 402. The igniter 420 is located in the igniter compartment 404 while the igniter switch 425 is located in the switch compartment 406. The igniter switch 425 is electrically connected to the igniter 420 via an electrical connector located in the initiator housing 402. In this manner, igniter switch 425 may transmit an electrical signal to the igniter 420 through the electrical connector 440 to ignite the igniter 420. The setting tool initiator 400 may thus activate setting tool 42 (not shown in FIG. 3) in response to the ignition of igniter 420.

Conventionally, the igniter 420 is separate from the igniter switch 425 by a bulkhead 415 positioned within initiator housing 402 between the igniter 420 and igniter switch 425. The bulkhead 415 may be separate from or integrated with the electrical connector 410. Conventionally, the bulkhead seals and provides a pressure barrier between the switch compartment 406 and the igniter compartment 404 such that hot and highly pressurized combustion gasses produced by the ignition of igniter 420 are prevented from entering the switch compartment 406 and thereby physically compromising or disabling the igniter switch 425. In this manner, the igniter switch 425 may remain in signal communication with the surface controller 13 following the ignition of igniter 420. For instance, the igniter switch 425 may be used to perform additional actions such as detonating the one or more shaped charges of the perforating gun 46 following the ignition of igniter 420.

While the conventional setting tool initiator 400 is configured to permit igniter switch 425 to survive the ignition of igniter 420, the survival of igniter switch 425 in-turn prevents the destruction or disablement of igniter switch 425 from providing a surface indication to the operator of system 10 that the setting tool 42 has successfully been activated to set the auxiliary tool 44. Instead, the operator at the surface is forced to rely on more time consuming (and hence costly) and less reliable techniques for discerning whether the auxiliary tool 44 has been successfully set, such as by applying tension to the work string 30 using the servicing rig 12 to determine if the auxiliary tool 44 has anchored against the casing 20. However, as described above, in some applications (e.g., relatively deep wells, off-shore applications) it is difficult if not impossible to determine whether the auxiliary tool 44 has been successfully set based on tension applied to the work string 30 as observed at the surface.

It may also be understood that if bulkhead 415 were removed from the conventional setting tool initiator 400 to intentionally compromise igniter switch 425 following the ignition of igniter 420, such a modification would require the combustion products produced by the combustible element of setting tool 42 to fill both the igniter compartment 404 and switch compartment 406. However, the igniter switch 425 is not positioned proximal igniter 420, and the switch compartment 406 has a relatively large volume compared to the volume of igniter compartment 404. The large volume of switch compartment 406, when filled with combustion products produced by the combustible element of setting tool 42, reduces the pressure force imparted by the combustion products against the piston 48 of setting tool 42, concomitantly reducing the setting force applied by the piston 48 of setting tool 42 to the auxiliary tool 44 for setting or actuating the auxiliary tool 44. Particularly, the increased volume occupied by the combustion products in the switch compartment 406 reduces the pressure of the combustion products by increasing the volume the products are permitted to expand into, reducing the effectiveness of the setting tool 42 in setting the auxiliary tool 44 by reducing the pressure force exerted by the setting tool 42 during actuation.

Figure 4:
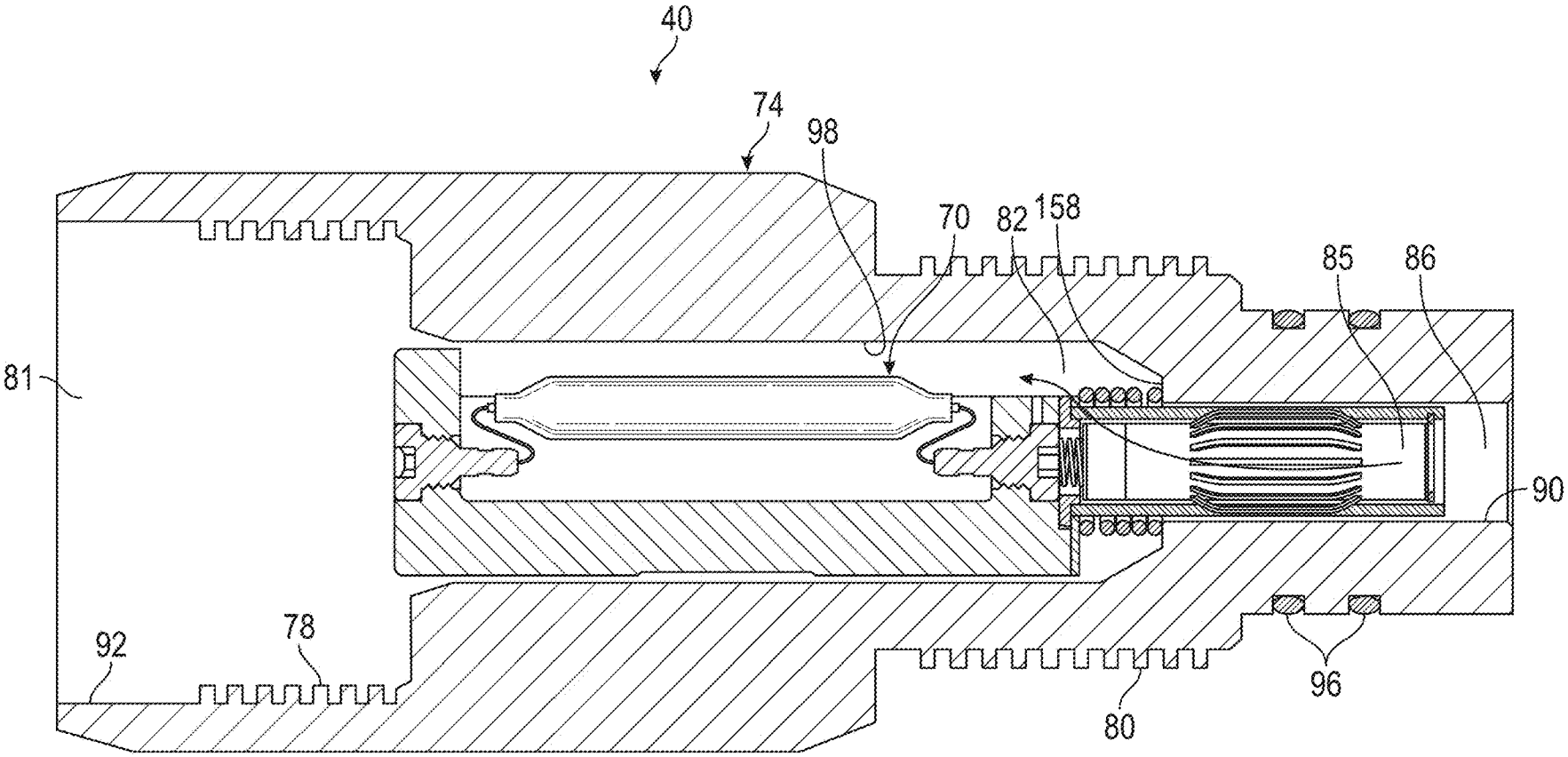
FIG. 4 is a partial cross-sectional view of an igniter switch assembly installed in a setting tool initiator according to an embodiment of the present disclosure.

Turning now to FIG. 4, an embodiment according to the current disclosure of the setting tool initiator 40 is shown. As will be explored in further detail below, unlike conventional setting tool initiator 400 shown in FIG. 3, setting tool initiator 40 of the current disclosure is configured to provide a surface indication of the successful ignition of an igniter 130 of the setting tool initiator 40 by disabling or disconnecting an electrical igniter switch 110 of the setting tool initiator 40. In this exemplary embodiment, setting tool initiator 40 generally includes an initiator housing 74 and an igniter switch module 70. The setting tool initiator 40 may connect with uphole components of tool string 32 (e.g., cable head 36) via the connector sub 60 shown in FIG. 2 and hidden from view in FIG. 4. As will be described further herein, igniter switch module 70 is configured to place igniter switch 110 in close proximity with igniter 130 whereby combustion products may be communicated to the igniter switch 110 while minimizing the amount of additional volume the combustion products must occupy following the ignition of igniter 130. In this manner, igniter switch module 70 permits the compromising of igniter switch 110 to serve as a surface indication of the successful actuation of setting tool 42 while also maximizing the effectiveness of setting tool 42 (by maximizing the pressure force exerted by setting tool 42 during actuation) in setting or actuating the auxiliary tool 44.

In this exemplary embodiment, the initiator housing 74 is a cylindrical shape with an uphole connector 78, a downhole connector 80, and a central bore or passage 81 extending between longitudinally opposed uphole and downhole ends of the initiator housing 74. In this exemplary embodiment, initiator housing 74 comprises a single, integrally or monolithically formed housing and the central passage 81 thereof receives the entirety of the igniter switch module 70. It may be understood however that in other embodiments initiator housing 74 may comprise a plurality of separate sectional housings which are threaded or otherwise connected together end-to-end.

In this exemplary embodiment, central passage 81 of initiator housing 74 includes a switch compartment 82, and an igniter compartment 86 that is connected to the switch compartment 82 by an unabridged interrupt flowpath 85 extending from the igniter compartment 86 to the switch compartment 82. In some embodiments, the interrupt flowpath 85 extends from the combustion compartment 53 and to the switch compartment 82 such that combustion products may be conveyed from the combustion compartment 53 to the switch compartment 82. The switch compartment 82 has an inner housing surface 98, a grounding surface 88, and transitions to the igniter compartment 86. The uphole connector 78 includes an upper seal surface 92 to seal against a corresponding seal assembly of the connector sub 60 to prevent well bore fluids from entering the initiator housing 74. The downhole connector 80 includes a seal assembly 96 configured to seal against a corresponding seal surface defining the combustion compartment 53 of the setting tool 42. The igniter switch module 70 can be installed inside the switch compartment 82 of the initiator housing 74. The igniter attached to the igniter switch module 70 installs into the igniter compartment 86. Initiator housing 74 is configured to minimize the volume of switch compartment 82 such that the volume occupied by the combustion products generated by setting tool 42 during actuation is low enough such that the combustion products may maintain a pressure sufficient to fully set or actuate the auxiliary tool 44. In this exemplary embodiment, the switch compartment 82 has a maximum inner diameter of 1.50 inches (in) or less to thereby minimize the volume of switch compartment 82; however, it may be understood that the maximum inner diameter of switch compartment 82 may vary in other embodiments.

Figure 5:
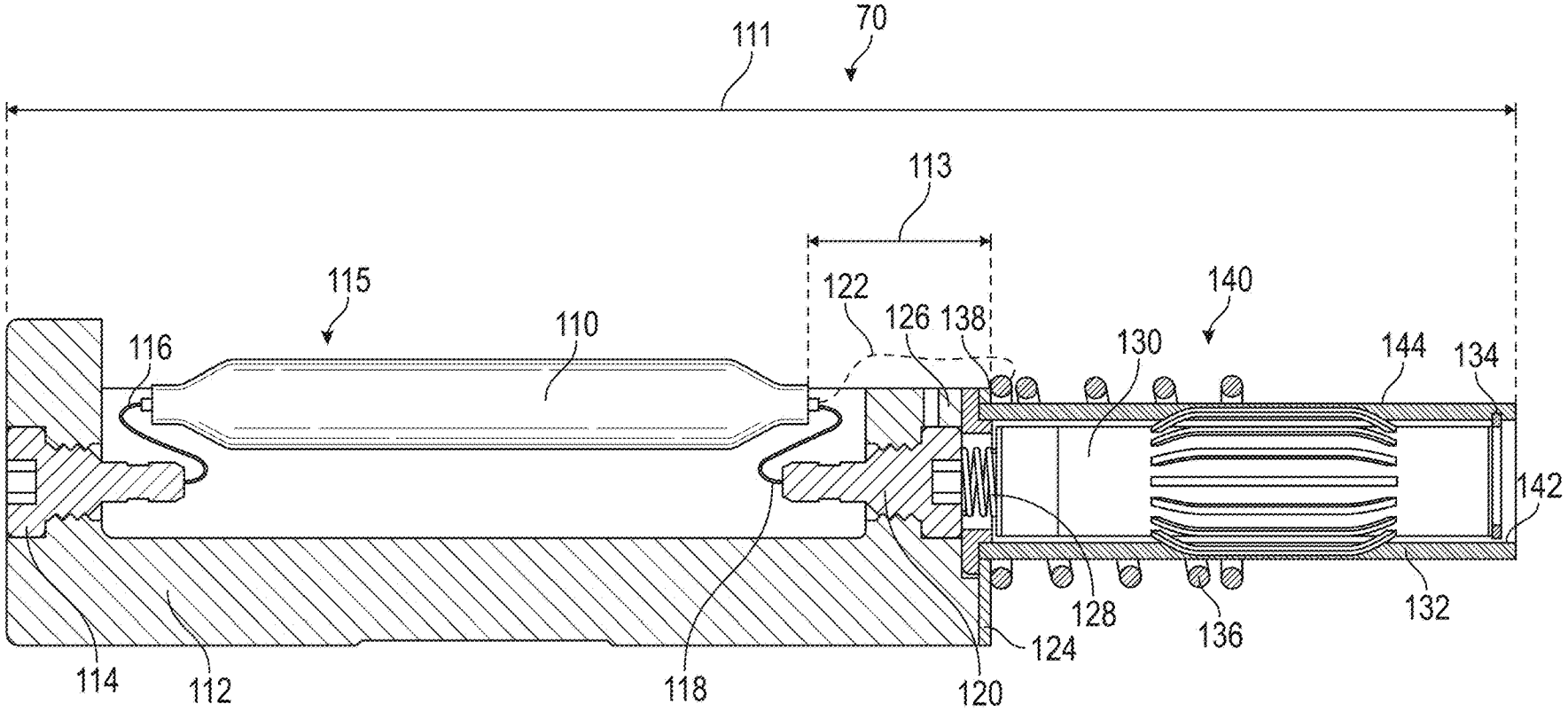
FIG. 5 is a partial cross-sectional view of an igniter switch assembly according to an embodiment of the present disclosure.

The igniter switch module 70 can be tested by the operator for electric connectivity before being installed into the switch compartment 82. As an example, the operator may measure electrical resistance of the igniter 130 after being installed into the igniter switch module 70 by contacting a first lead of a resistance meter to downhole electrical contact 120 and contacting a second lead of the meter to tube 132. Turning now to FIG. 5, in this exemplary embodiment, the igniter switch module 70 generally includes a main body or switch chassis 112, igniter switch 110, an igniter adapter 140, and igniter 130. Igniter switch module 70 allows for the igniter switch 110 and igniter 130 to be pre-connected and installed together as a single unit into the initiator housing 74. As described above, igniter switch module 70 places the igniter switch 110 into close proximity with the igniter 130 so as to maximize the effectiveness of setting tool 42 during actuation. The igniter switch module 70 has a maximum length 111 extending from an uphole end of the switch chassis 112 to a downhole end of the igniter adapter 140. In this exemplary embodiment, the maximum length 111 of igniter switch module 70 is approximately 6.5 in or less; however, it may be understood that the maximum length 111 of igniter switch module 70 may vary in other embodiments.

The switch chassis 112 of igniter switch module 70 may be made of a non-electrically conductive material (e.g., plastic) such as glass filled nylon. Switch chassis 112 has an uphole electrical contact 114 and a downhole electrical contact 120 for communicating signals to the igniter 130 as will be disclosed further herein. In this exemplary embodiment, igniter adapter 140 includes a tube 132, a flange 124, and a ground or flange spring 136. The tube 132 may be connected or attached to a flange 124 by a weld 138, by fasteners, or by other means. Flange spring 136 may be connected or attached to the flange 124 by a weld 138, by a bent tab, by fasteners, or by other means.

In this exemplary embodiment, igniter switch module 70 additionally includes an igniter spring 128 and a shoulder washer 126. Igniter spring 128 and shoulder washer 126 are installed between the switch chassis 112 and the igniter adapter 140. Tube 132 comprises one or more tabs that bend outwards to secure the tube 132 to the switch chassis 112 and to secure the flange spring 136. The igniter adapter 140 may be attached to the switch chassis 112 with fasteners such as screws. In this exemplary embodiment, igniter 130 is installed into the tube 132 of the igniter adapter 140 and secured in place with a snap ring 134 or any other suitable fastener. Igniter switch 110 is connected to the uphole electrical contact 114 with an uphole switch wire 116. Additionally, igniter switch 110 is connected to the downhole electrical contact 120 with a downhole switch wire 118. A grounding wire 122 from the igniter switch 110 may be connected to a screw or similar location on the front of the igniter adapter 140. The uphole switch wire 116, downhole switch wire 118, and igniter switch 110 collectively form a switch circuit 115 (shown in FIG. 5) which is electrically disconnected in response to the circulation of combustion products to the switch compartment 82 and the concomitant exposure of the switch circuit 115 to the combustion products. For example, one or more of the wires 116 and 118 and igniter switch 110 may be physically compromised following circulation of the combustion products to the switch compartment 82. Additionally, while in this exemplary embodiment the igniter switch 110 is positioned in the switch compartment 82, in other embodiments, igniter switch 110 may be positioned external the switch compartment 82 with another portion of the switch circuit 115 (e.g., downhole switch wire 118) positioned in the switch compartment 82.

The igniter switch 110 has an operational state in which the igniter switch 110 is configured to receive electrical signals from the surface 5 and an inoperable state in which the igniter switch 110 is not configured to receive electrical signals from the surface 5. Setting tool initiator 40 is configured to shift igniter switch 110 from the operational state to the inoperable state in response to the ignition of the igniter 130 which results in the communication of combustion products to the switch chamber 82. For example, the igniter switch 110 may be shifted to the inoperable state by rendering electrically inoperable (e.g., physically compromising) the igniter switch 110 itself or another component of the switch circuit 115 such as uphole switch wire 116.

Igniter switch module 70 positions the igniter switch 110 at a predefined distance 113 from the igniter 130, where the predefined distance is contingent or based on the length of the switch chassis 112, and the length of igniter switch 128 when compressed by the igniter 130. It may be understood that a limited degree of movement may be permitted between igniter switch 110 and igniter 130 and thus the predefined distance 113 may comprise a predefined range. For example, in some embodiments, the predefined distance 113 is approximately 1.75 in or less; however, it may be understood that in other embodiments the predefined distance 113 may vary.

Signals transmitted from an operator at the surface can be communicated to the igniter 130 as will be described herein. For example, the operator may transmit an igniter signal down the electrical conductor 28 within the work string 30 to the tool string 32 shown in FIG. 2. The igniter signal is communicated from the electrical conductor 28 within the work string 30, through the electrical contacts within the signal sub 34, and to the setting tool initiator 40 shown in FIG. 4 via the connector sub 60. From connector sub 60, the igniter signal travels to the igniter switch module 70. The transmitted signal passes through the uphole contact 114 and, the uphole switch wire 116, and to the igniter switch 110. In some embodiments, the igniter switch 110 comprises an addressable switch, including, for example, a printed circuit board, a processor (e.g., a microprocessor or central processing unit (CPU)), and a memory device including instructions stored therein defining the operation of igniter switch 110. The igniter switch 110 has an operational state or configuration in which the igniter switch can receive signals transmitted from surface. For example, when in the operational state, igniter switch 110 may identify an address and a command within the signal, compare the transmitted address to the programmed address within the memory of the igniter switch 110, and execute the command if the transmitted address matches the address in memory. If the transmitted address matches the address in memory, a firing circuit of the igniter switch 110 is opened and permits the voltage and current to be provided to the igniter 130 via the downhole switch wire 118, the downhole contact 120, and the igniter spring 128. As will be discussed further herein, igniter switch 110 additionally includes a disabled or compromised state or configuration in which the switch 110 is not configured to receive signals transmitted from the surface. For example, in the disabled state the igniter switch 110 may be damaged or otherwise physically compromised. As another example, in the disabled state, the circuit connecting igniter switch 110 to the surface controller 13 may be physically damaged or otherwise compromised. It may also be understood that in other embodiments the configuration of igniter switch 110 may vary. For example, in other embodiments, igniter switch 110 may comprise a diode-based switch and may not include a processor or a memory device.

The igniter 130 is grounded to the igniter adapter 140 via biasing members or springs integral to the body of the igniter 130 that contact the inner surface 142 of the tube 132 of the igniter adapter 140. The igniter adapter 140 is grounded to initiator housing 74 of the setting tool initiator 40, as shown in FIG. 4, via the flange spring 136 in contact with the grounding surface 88 of the initiator housing 74. The igniter switch 110 may also be grounded to the grounding surface 88 of the initiator housing 74 via grounding wire 122 that is connected to the igniter adapter 140.

The igniter 130 ignites in response to the igniter switch 110 conveying the signal (e.g., the necessary voltage and current) necessary to initiate the pyrotechnic material of the igniter 130. The resultant flame jets out of the downhole end of the igniter 130 to ignite the combustible element 49 within the combustion compartment 53 of the setting tool 42. The burning or detonation of the combustible element 49 creates a high pressure and high temperature gaseous pressure within the combustion compartment 53 that strokes the piston 48 of the setting tool 42 to set or actuate the auxiliary tool 44. The high pressure and high temperature gases pass between the outer surface 74 of the tube 132 on the igniter adapter 140 and the inner surface 90 of the igniter compartment 86 of the initiator housing 74 to fill the switch compartment 82 of the setting tool initiator 40. In this manner, the environment within the switch compartment 82 of the setting tool initiator 40 changes from a pressure near atmospheric pressure (e.g., 14.7 psi) to a substantially elevated pressure (e.g., a pressure exceeding 10,000 pounds per square inch (PSI)).

As a result of ignition, the igniter switch 110 breaks the circuit, e.g., creates an open circuit, due the change in environmental conditions within the switch compartment 82, e.g., high pressure and high temperature of the gases within the switch compartment 82. Hot pressurized combustion products generated by the ignition of igniter 130 and of the combustible element 49 of the setting tool 42 (the combustible element 49 being in fluid communication with igniter 130) are communicated or flow along flowpath 85 shown in FIG. 4 from the igniter compartment 86 to the switch compartment 82 where the combustion products contact the igniter switch 110 and shift the igniter switch 110 from the operational state to the disabled state. Particularly, the combustion products physically damage or otherwise compromise the physical integrity of igniter switch 110 and/or other circuitry connected thereto (e.g., uphole switch wire 116) whereby igniter switch 110 is no longer connected to surface controller 13 or configured to send or receive signals.

The operator at surface may register the short circuit, i.e., end of communication, as a positive and mechanical surface indication that the combustible element 49 within the setting tool 42 has burned and actuated the setting tool 42 to activate the auxiliary tool 44. In this manner, the operator need not rely on the unreliable practice of applying tension to work string 30 at the surface to determine whether the auxiliary tool 44 has been set. Moreover, igniter switch module 70 places the combustible element 49 and particularly igniter 130 into close proximity with igniter switch 110, thereby ensuring the destruction of igniter switch 110 while minimizing the volume of the central passage 81 of initiator housing 74 and thus the volume which is occupied by the combustion products following the ignition of the igniter 130. Minimizing the volume occupied by the combustion products generated by the ignition of igniter 130 and the combustible element 49 maximizes the pressure force imparted by the combustion products to the piston 48 of the setting tool 42 which strokes in response to the ignition of the igniter 130. The minimization of the volume of central passage 81 may thus assist in ensuring the piston 48 of setting tool 42 fully strokes to thereby fully and successfully set the auxiliary tool 44.

Figure 6:
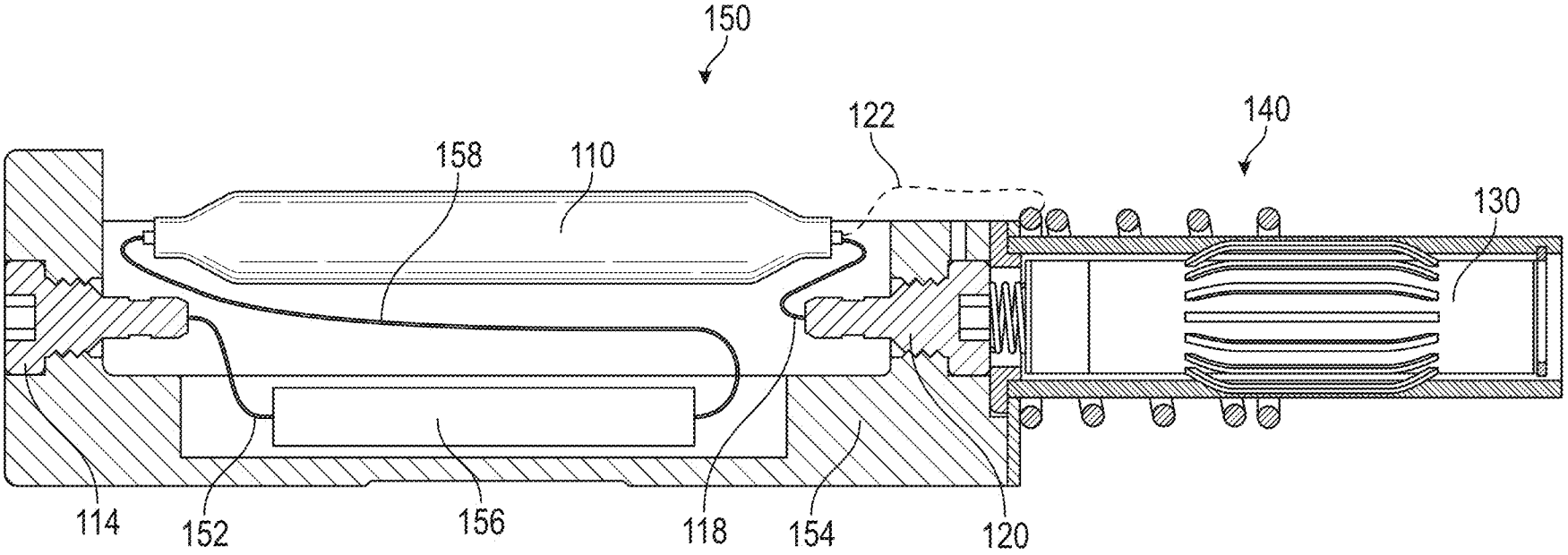
FIG. 6 is a partial cross-sectional view of an igniter switch assembly according to another embodiment of the present disclosure.

In an embodiment, a circuit breaker in the igniter switch module 70 disconnects the communication path to the igniter switch 110. Turning now to FIG. 6, in this embodiment, an igniter switch module 80 comprises the igniter switch 110, a main body 154 housing the igniter switch 110, a circuit breaker 156, the igniter adapter 140, and the igniter 130. The circuit breaker 156 can be a thermal switch, pressure switch, or an impact switch. The circuit breaker 156 is electrically connected within the circuit between the uphole contact 114 and the igniter switch 110. An electronic signal transmitted from surface controller 13 is communicated through the electrical conductor 28 in the work string 30, through the signal sub 34, and to the uphole contact 114 on the igniter switch module 80. In this exemplary embodiment, the signal from surface controller 13 passes through the uphole contact, a second switch wire 82, the circuit breaker 156, the uphole switch wire 88, to the igniter switch 110. The electronic signal from surface controller 13 may pass through the circuit breaker 156 until a predetermined value is reached and the circuit breaker 156 cuts off communication to the igniter switch. If the circuit breaker 156 is a thermal switch, the thermal switch breaks communication with the igniter switch 110 when the temperature exceeds a predetermined value (e.g., 500 degrees Fahrenheit (° F.). If the circuit breaker 156 is an impact switch, the impact switch (i.e., accelerometer) breaks communication with the igniter switch 110 when the impact force (i.e., acceleration) exceeds a predetermined value (e.g., 10 g).

In this exemplary embodiment, when the surface controller 13 transmits an electronic signal to the igniter switch 110 and the transmitted address matches the address in memory, the igniter switch 110 opens the firing circuit thereof to permit the transmission of the voltage and current to the igniter 130 via the downhole switch wire 118, the downhole contact 120, and the igniter spring 128. The igniter 130 ignites and the resultant flame jets out to ignite the combustible element 49 within the combustion compartment 53 of the setting tool 42. The burning or detonation of the combustible element 49 creates a high pressure and high temperature gaseous pressure within the combustion compartment 53 that strokes the piston 48 on the setting tool 42 to set or actuate the auxiliary tool 44. The high pressure and high temperature gases pass between the outer surface 74 of the tube 132 on the igniter adapter 140 and the inner surface 90 of the igniter compartment 86 of the initiator housing 74 to fill the switch compartment 82 of the setting tool initiator 40. The circuit breaker 156 disconnects or breaks communication with the igniter switch 110 when a predetermined value is reached or exceeded. For example, if the circuit breaker 156 is a pressure switch, the pressure switch breaks communication with the igniter switch 110 when the pressure exceeds a predetermined value (e.g., 10,000 PSI). The operator may register the end of communication, or a break in communication, with the igniter switch 110 at surface controller 13 as an indication that the setting tool 42 has functioned to set the auxiliary tool 44.

Figure 7:
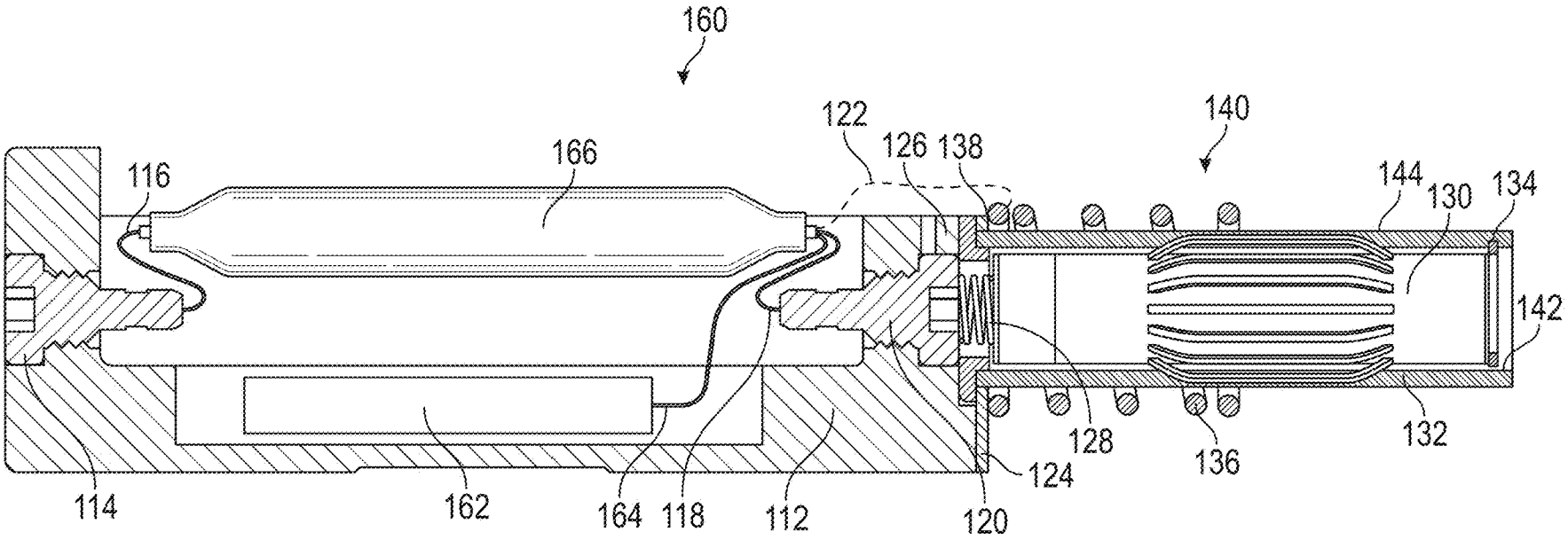
FIG. 7 is a partial cross-sectional view of an igniter switch assembly according to still another embodiment of the present disclosure.
Figure 8:
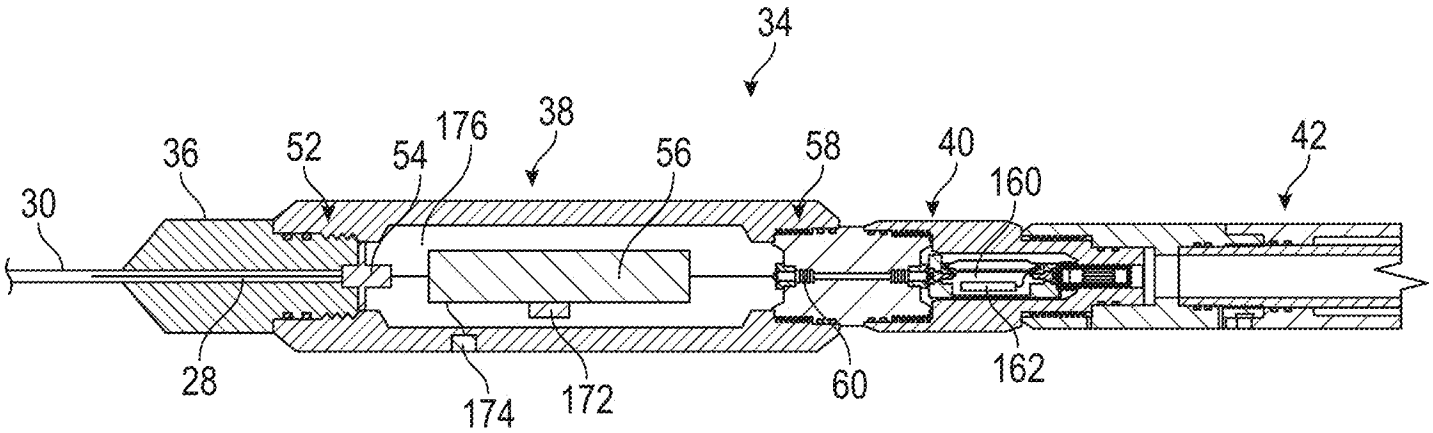
FIG. 8 is a cross-sectional view of a signal sub according to an embodiment of the present disclosure.

In an embodiment, an environmental sensor within the switch module indicates the setting tool 42 has functioned. Turning to FIG. 7, in this embodiment, an igniter switch module 160 comprises the igniter switch 166, an environmental sensor 162, the igniter adapter 140, and the igniter 130. The environmental sensor 162 can be a thermometer, a pressure transducer, an accelerometer, or an acoustic sensor. The igniter switch module 160 can have any combination of one or more environment sensors 162. The environmental sensors 162 are electrically connected to the igniter switch 166 with a sensor wire 164. In this exemplary embodiment, an electronic signal transmitted from surface controller 13 is communicated through the electrical conductor 28 in the work string 30, through the signal sub 34, and to the uphole contact 114 on the igniter switch module 160. The signal transmitted from surface controller 13 passes through the uphole contact 114, the uphole switch wire 116, to the igniter switch 166. As previously described, the igniter switch 166 can be an addressable switch. Likewise, the one or more environmental sensors 162 can be addressable through the addressable igniter switch 166.

An electronic signal from surface controller 13 can command the igniter switch 166 to transmit one or more measurements at a predetermined periodic rate from the environmental sensors 162. For example, the environmental sensor 162 can be a temperature sensor (e.g., thermocouple) that measures the temperature within the switch compartment 82 of the initiator housing 74. For example, the environmental sensor 162 can be a pressure sensor (e.g., pressure transducer) that measures the pressure within the switch compartment 82 of the initiator housing 74. As another example, the environmental sensor 162 can be an accelerometer that measures the acceleration (e.g., motion)

of the initiator housing 74. As another example, the environmental sensor 162 can be an acoustic sensor (e.g., microphone, piezoelectric transducer) that measures the acoustic waves or sound levels within the switch compartment 82 of the initiator housing 74. The surface controller 13 may transmit an electronic signal with a command to activate to the igniter 130 and a second command to transmit the measurements at a predetermined periodic rate from the environmental sensor 162.

When the igniter switch 110 receives the commands, the igniter switch 110 transmits a signal (e.g., a predetermined voltage and current) to the igniter 130 via the downhole switch wire 118, the downhole contact 120, and the igniter spring 128. The igniter switch 166 can measure and transmit the measured data from the one or more environmental sensors 162. The igniter 130 ignites and the resultant flame jets out the distal end to ignite the combustible element 49 within the combustion compartment 53 of the setting tool 42. The burning or detonation of the combustible element 49 creates a high pressure and high temperature gaseous pressure within the combustion compartment 53 that strokes the piston 48 of the setting tool 42 to set or actuate the auxiliary tool 44. The service personnel receive the transmitted data from the one or more environmental sensors 162. The change of measured data, for example an increase in the temperature, observed at surface can indicate that the setting tool 42 has functioned to set the auxiliary tool 44.

In an embodiment, the signal sub 34 has a plurality of environmental sensors in two or more locations that provide feedback to the operator at the surface that the setting tool 42 has functioned to set or activate an auxiliary tool 44. The setting tool initiator 40 can include the igniter switch module 160 with one or more environmental sensors 162. The instrument sub 38 can include one or more environmental sensors 56. The environmental sensors can have an internal sensor 172, an external sensor 174, or any combination thereof. The internal sensor 172 can provide measurements at a predetermined periodic rate of the environment inside the instrument compartment 176. The external sensor 174 can provide measurements at a predetermined periodic rate of the wellbore environment exterior of the instrument sub 38. The environmental sensor 56 can be one or more of a temperature sensor, a pressure transducer, an accelerometer, a magnetic sensor, or an acoustic sensor. The environmental sensor 56 can include pressure and temperature sensors to measure the pressure and temperature of the wellbore environment, the pressure and temperature of the instrument compartment 176 of the instrument sub 38, or any combination thereof. The environmental sensor 56 can include a motion sensor that can be one or more accelerometers. The measurements of the accelerometers can indicate motion of the setting tool. The environmental sensor 56 can include a magnetic sensor commonly referred to as a collar locator. The magnetic sensor measures the magnetic response of the casing, liner, or tubing. The collars that connect the casing, liner, or tubing have a different magnetic signature than the tubing bodies. The collar locator measures and counts the collars. The number of collars counted can be correlated to a tubing tally to indicate the location of the setting tool initiator within the wellbore. The environmental sensor 56 can include an acoustic sensor (e.g., microphone, piezoelectric transducer) that measures the acoustic waves or sound levels within the instrument compartment 176 of the instrument sub 38 or the acoustic waves external to the instrument sub 38.

As previously described, the surface controller 13 transmit a signal to the igniter switch module 160 to ignite the igniter 130 and subsequently ignite the combustible element 49 in the setting tool 42. The surface controller 13 can also transmit a signal to the environmental sensor 162 on the igniter switch module 160 and the environmental sensor 56 within the instrument sub 38. The environmental sensor 162 and environmental sensor 56 can measure at a predetermined periodic rate and transmit the measurements to service personnel at surface. Any combination of measured data from the instrument sub 38 or the igniter switch module 160 observed at surface by the operator can indicate the that the setting tool 42 has set the auxiliary tool 44. For example, an increase in the temperature measured by the environmental sensor 162 within the igniter switch module 160 along with motion measured by the environmental sensor 56 within the instrument sub 38 can indicate that the setting tool 42 has functioned to set the auxiliary tool 44.

In an embodiment, the signal sub 34 can comprise an instrument sub 38 with one or more environmental sensors 56, and the setting tool initiator 40 may include circuit breaker 156. As previously described, the surface controller 13 can transmit a signal to the igniter switch module 160 to ignite the igniter 130 and subsequently ignite the combustible element 49 in the setting tool 42. The service personnel can also transmit a signal to the environmental sensor 56 within the instrument sub 38. The environmental sensor 56 can measure at a predetermined periodic rate and transmit the measurements to the operator at surface. The operator can monitor communication with the igniter switch module 160 within the setting tool initiator 40. The circuit breaker 156 will end electrical communication with the igniter switch module 160 when a predetermined environmental condition is met. Any combination of measured data from the instrument sub 38 or loss of electrical communication with the igniter switch module 160 observed at surface by the operator can indicate the that the setting tool 42 has set the auxiliary tool 44.

Figure 9:
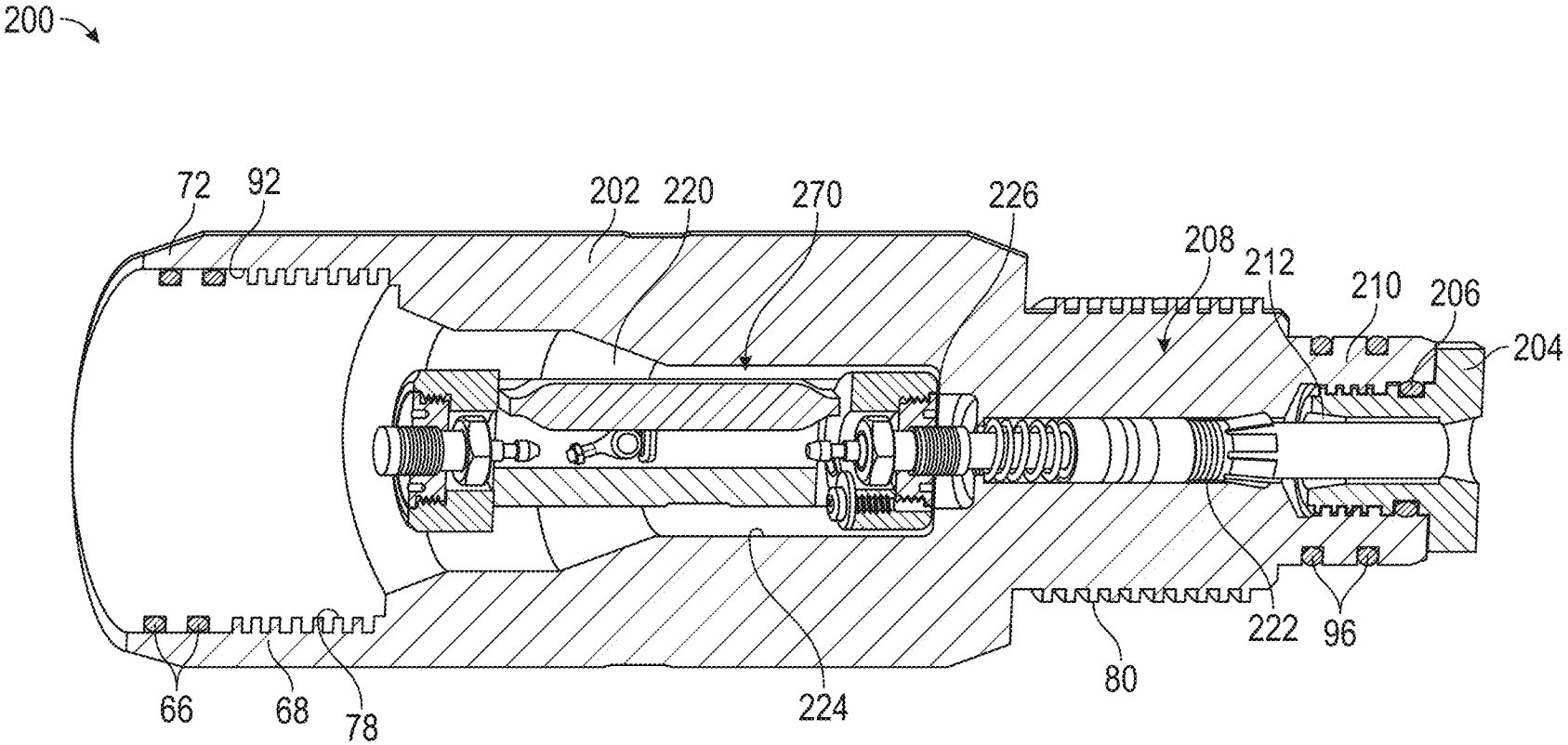
FIG. 9 is a partial cross-sectional view of an igniter switch assembly installed in a setting tool initiator according to another embodiment of the present disclosure.

The pressure within the combustion compartment 53 of the setting tool 42 after the combustible element 49 is ignited can actuate a piston 48 to ground out the igniter switch assembly. In an embodiment shown in FIG. 9, the setting tool initiator 200 includes a movable isolator that grounds out the igniter switch assembly. In this exemplary embodiment, the setting tool initiator 200 generally includes a switch housing 202, an igniter retainer 204, a movable isolator 208, and an igniter switch module 270. The switch housing 202 is a cylindrical shape with an uphole connector 78, a downhole connector 80, an inner thread 212, a switch compartment 220, and an igniter compartment 222 connected to the switch compartment 220 by an uninterrupted fluid flowpath. In this exemplary embodiment, the switch compartment 220 has an inner housing surface 224, and an isolator port 226. The uphole connector 78 includes an upper seal surface 92. The downhole connector 80 includes a lower seal assembly 96. The housing connector 72 sealingly couples to the switch housing 202 to form a seal to prevent well bore fluids from entering the switch compartment 220. The downhole connector 80 and seal assembly couple the setting tool initiator 200 to the combustion compartment 53 of the setting tool 42. The installation of the igniter switch module 270 and the igniter will be explained in more detail herein.

Figure 10:
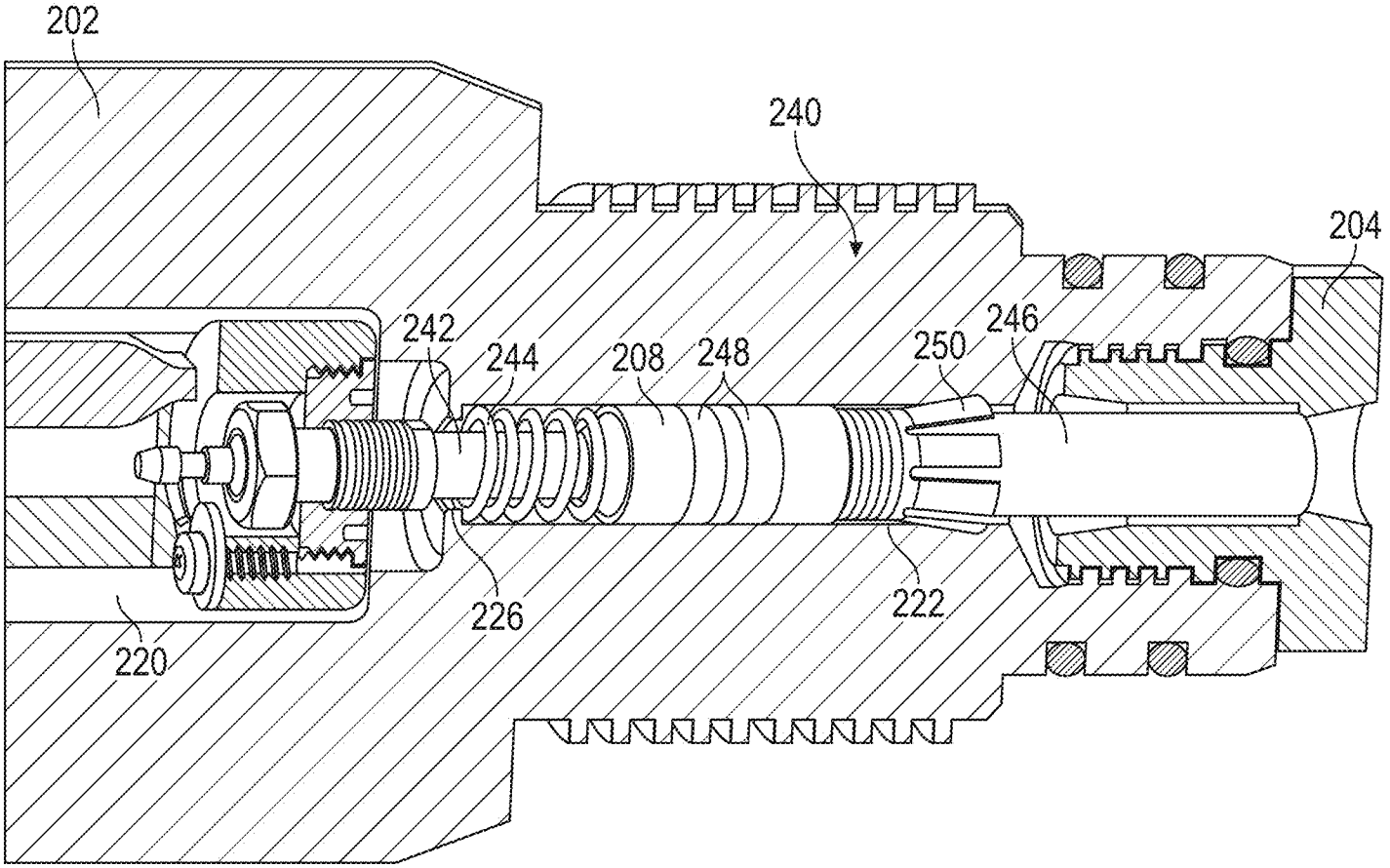
FIG. 10 is a partial cross-sectional view of an igniter assembly installed in a setting tool initiator according to an embodiment of the present disclosure.

Turning to FIG. 10, the igniter assembly 240 can be installed into the igniter compartment 222. In this exemplary embodiment, the igniter assembly 240 generally include an insulated pin connector 242, a retaining spring 244, movable isolator 208, and an igniter 246. The insulated pin connector 242 and movable isolator have an electrically conductive core to communicate electrical signals to the igniter 246. The insulated pin connector 242 has an outer shell of insulating material. The movable isolator has a seal assembly 248 that can comprise one or more seals with various seal retaining structures. The igniter 246 includes a grounding spring 250 that electrically couples to the igniter compartment 222 of the switch housing 202. The insulated pin connector 242 is coupled to the movable isolator 208 by threads, fasteners, welding, or similar joining methods. The retaining spring 244 can be installed over the insulated pin connector 242 and movable isolator 208. The retaining spring 244, insulated pin connector 242, and movable isolator 208 with seal assembly 248 can be installed into the igniter compartment 222. The igniter 246 can be installed into the igniter compartment 222 and retained with the igniter retainer 204.

Figure 11:
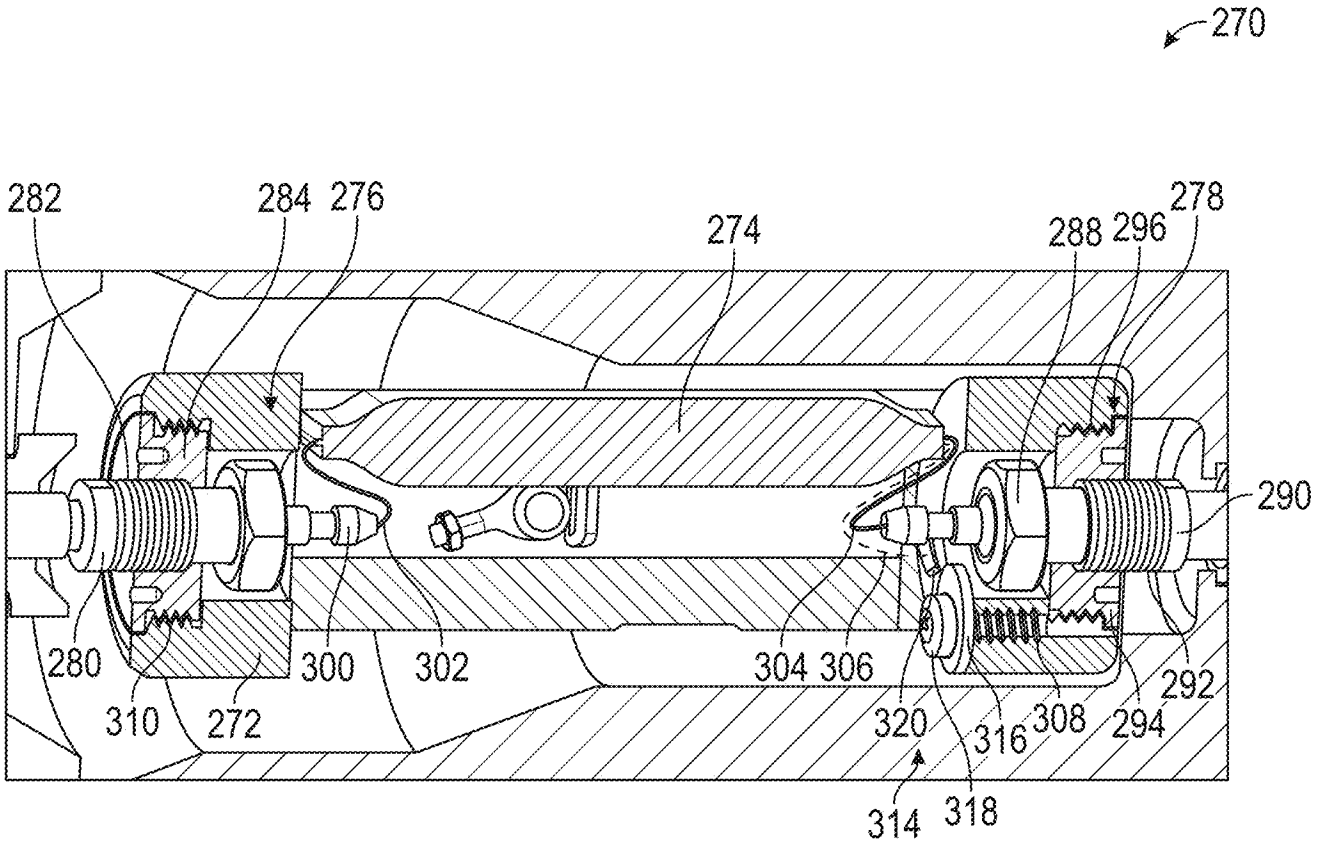
FIG. 11 is a partial cross-sectional view of an igniter switch assembly according to a further embodiment of the present disclosure.

The igniter switch module can be tested by the operator for electric conductivity before being installed into the setting tool initiator. Turning now to FIG. 11, the igniter switch module 270 can comprise, a main body 272, an igniter switch 274, an upper pin assembly 276, a lower pin assembly 278, and a grounding point assembly. The main body 272 can be made of a non-electrically conductive material (e.g., plastic) such as a glass filled nylon. The upper pin assembly 276 comprises a pin connector 300, a connector post 280, a connector spring 282, and a spring retainer 284. The connector spring 282 and spring retainer 284 slidingly fit over the connector post 280 with an allowance fit. The pin connector 300 can couple to the connector post 280 with threads, fasteners, or any other method of joining. The upper pin assembly 276 can threadingly connect to the main body 272 with a threaded connection 310. In this exemplary embodiment, the lower pin assembly 278 comprises a pin connector 288, a connector post 290, a connector spring 292, and a spring retainer 294. The lower pin assembly 278 can threadingly connect to the main body 272 with a thread connection 296. In this exemplary embodiment, the igniter switch module 270 includes a grounding point assembly 314 comprising a washer 316, a fastener 318, and a grounding wire connector 320. The fastener 318 can thread into a port 308 to attach the grounding point assembly 314 onto the main body 272. The igniter switch 274 can be connected to the upper pin assembly 276 with an uphole switch wire 302 and connected to the lower pin assembly 278 with a downhole switch wire 304. A grounding wire 306 from the igniter switch 274 can be connected to the grounding wire connector 320 of the grounding point assembly 314.

The pressure inside the setting tool 42 will ground out the igniter switch 274. Returning to FIG. 9, the setting tool initiator is assembled by installing the igniter assembly 240 into the igniter compartment 222 and threadingly connecting the igniter retainer 204 to the switch housing 202. The igniter switch module 270 can be tested before installing into the switch compartment 220 of the switch housing 202. The housing connector 72 is threadingly connected to the switch housing 202. The switch housing 202 is threadingly coupled to the setting tool 42 with the downhole connector 80 and seal assembly 96 of switch housing 202. Turning to FIG. 10, the retaining spring 244 bias the movable isolator 208 towards the isolator port 226. The igniter 246 is pushed into contact with the igniter retainer 204 by the spring force of the retaining spring 244. The atmospheric pressure on either side of the seal assembly 248 on the movable isolator 208 is approximately equal. The pressure uphole of the seal assembly 248 is the pressure inside the switch compartment 220 that is approximately atmospheric pressure. The pressure downhole of the seal assembly 248 is the pressure inside the setting tool 42 that is approximately atmospheric pressure. Therefore, the movable isolator 208 is pressure balanced.

Figure 12:
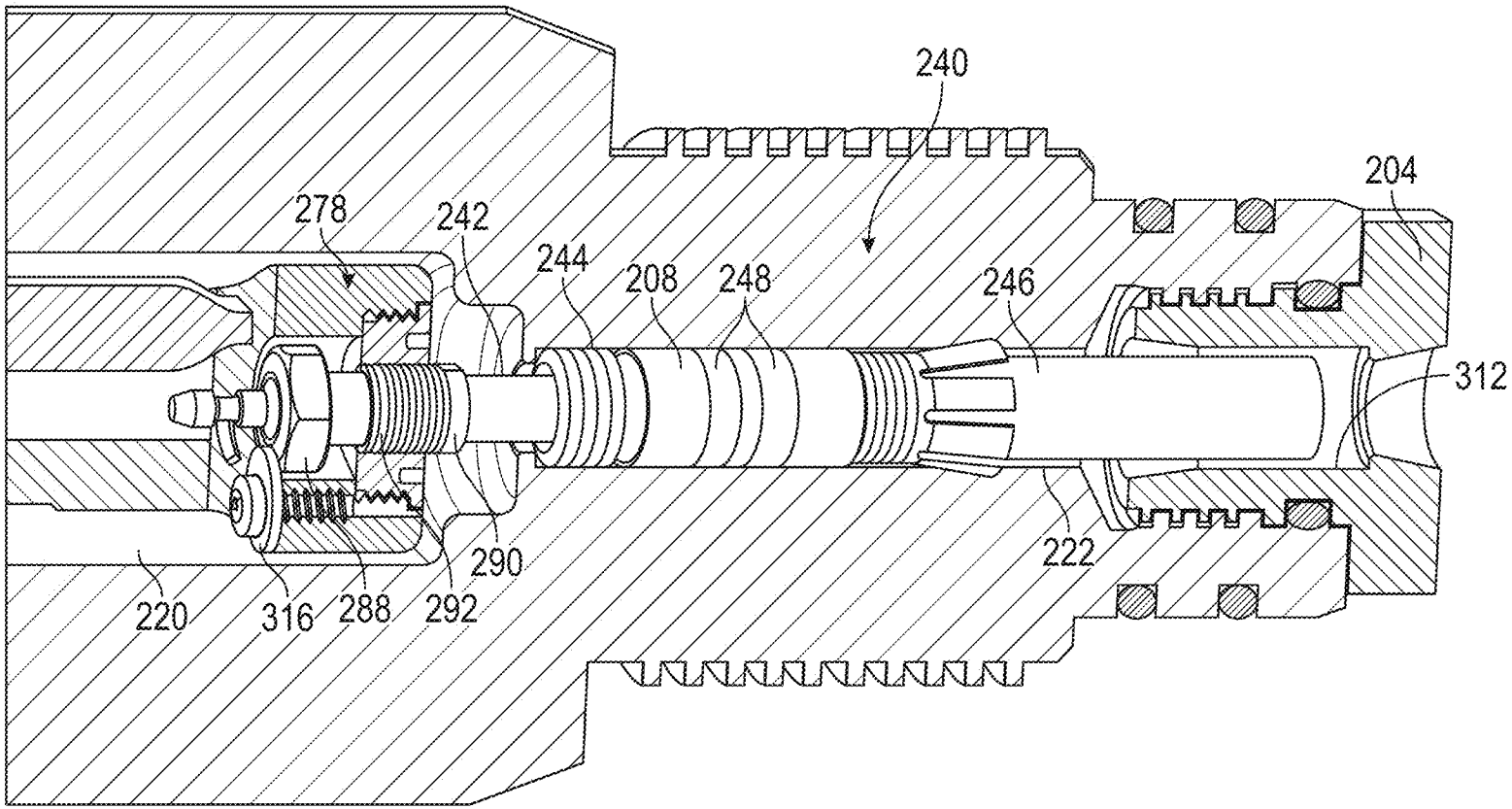
FIG. 12 is a partial cross-sectional view of an igniter assembly installed in a setting tool initiator in a second position according to a further embodiment of the present disclosure.

The ignition of the combustible element 49 inside the setting tool 42 by the igniter 246 will produce high pressure gas. Turning now to FIG. 12, pressure within the setting tool 42 is greater than pressure within the switch compartment 220 which unbalances the movable isolator 208 and bias the movable isolator towards the switch compartment 220. For clarity, the inner bore 312 of the igniter retainer 204 is fluidly connected to the setting tool 42 and therefore the pressure within the setting tool 42 is also the pressure within the inner bore 312. The fluid pressure within the inner bore 312 urges the movable isolator 208 and seal assembly 248 towards the switch compartment 220. The movement of the movable isolator 208 within the igniter compartment 222 towards the switch compartment 220 compresses the retaining spring 244 and extends the insulated pin connector 242 into the switch compartment 220. The movement of the insulated pin connector 242 into the switch compartment 220 pushes the connector post 290 of the lower pin assembly 278 towards the spring retainer 294, compresses the connector spring 292, and moves the pin connector 288 into contact with the washer 316 of the grounding point assembly 314. The contact of the pin connector 288 of the lower pin assembly 278 to the washer 316 of the grounding point assembly 314 grounds the igniter switch 274. The grounding of the igniter switch 274 breaks communication with the surface personnel.

Figure 13:
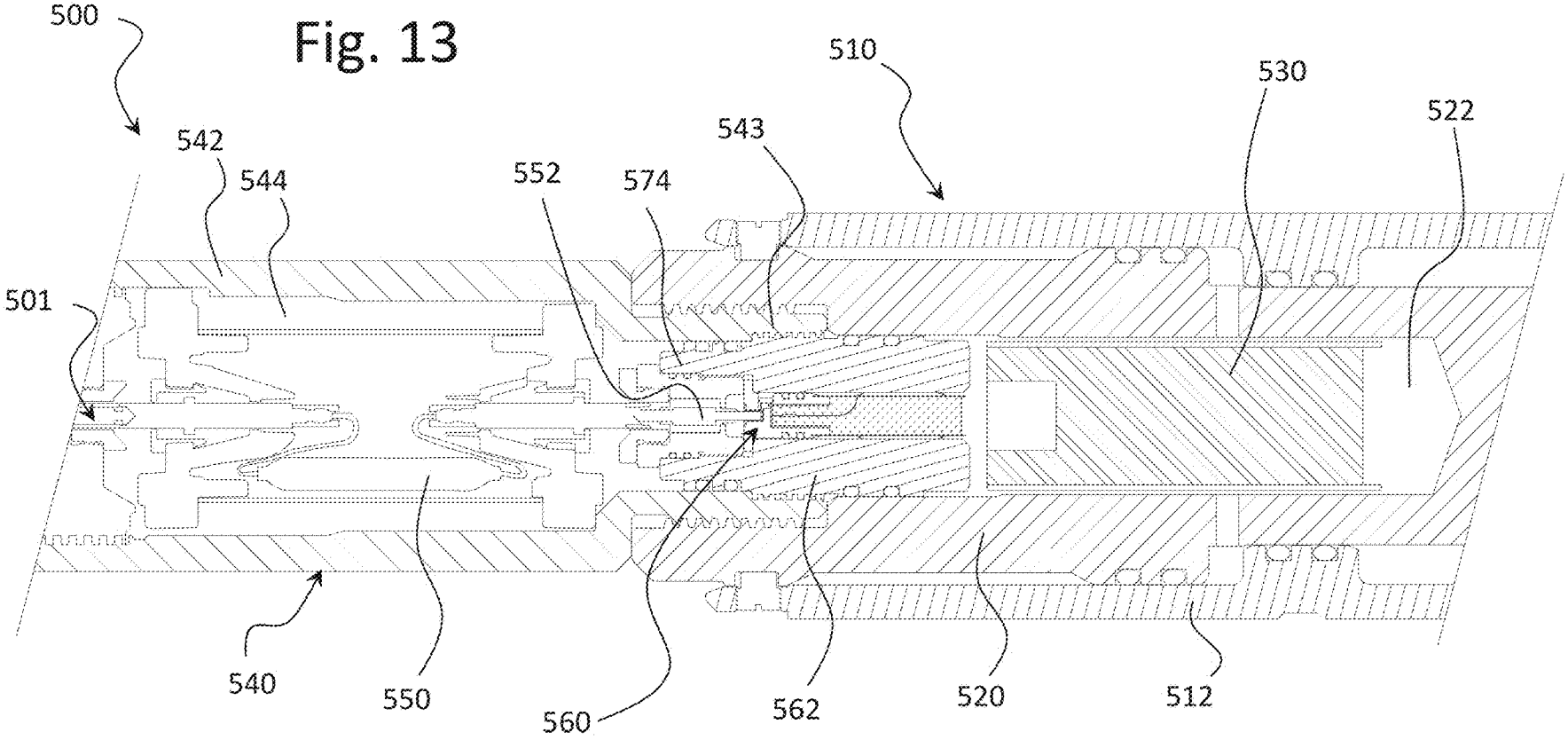
FIG. 13 is fragmentary elevation cross section of a further embodiment of the disclosure.
Figure 14:
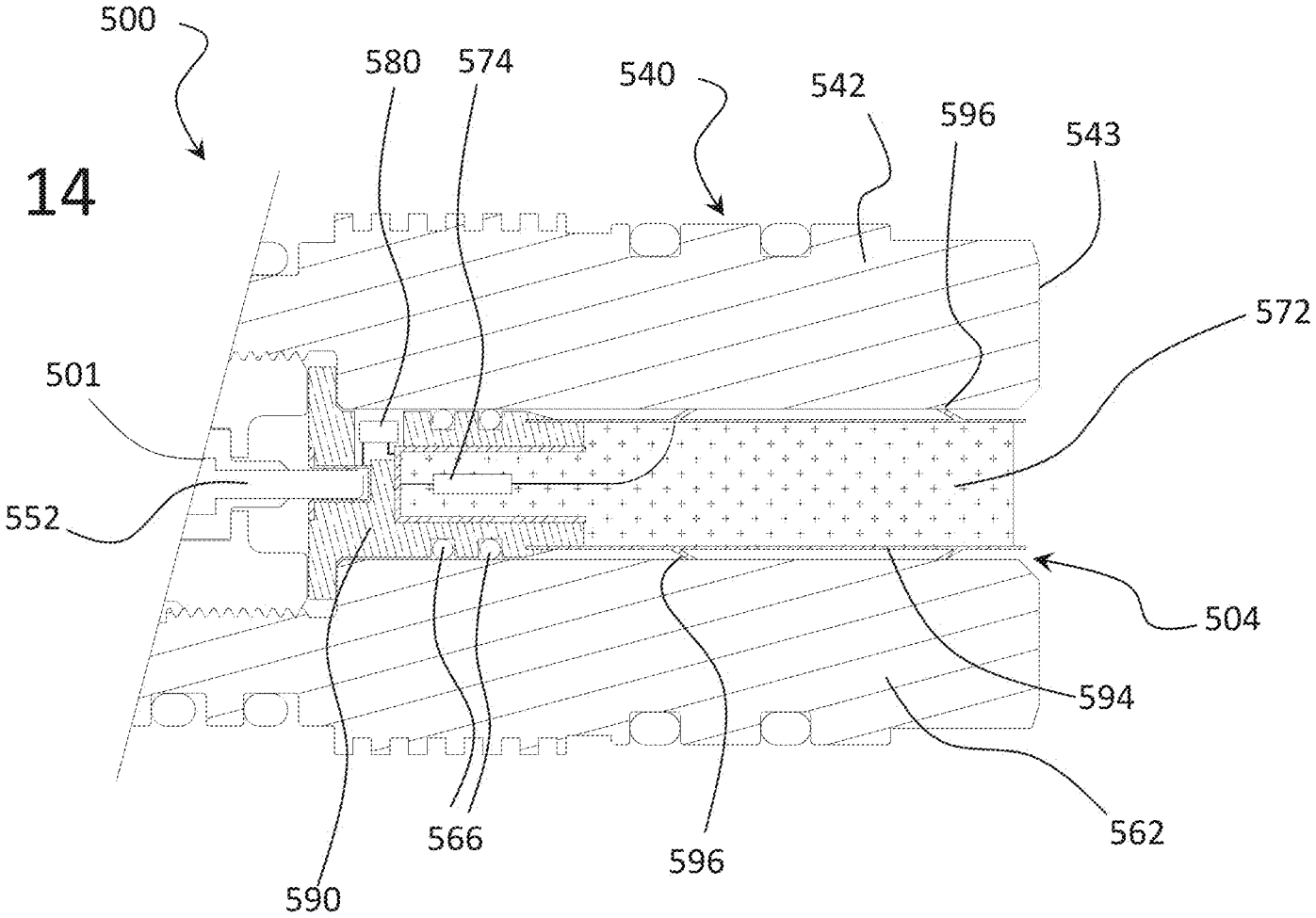
FIG. 14 is an enlarged fragmentary cross section view of the embodiment shown in FIG. 13.
Figure 15:
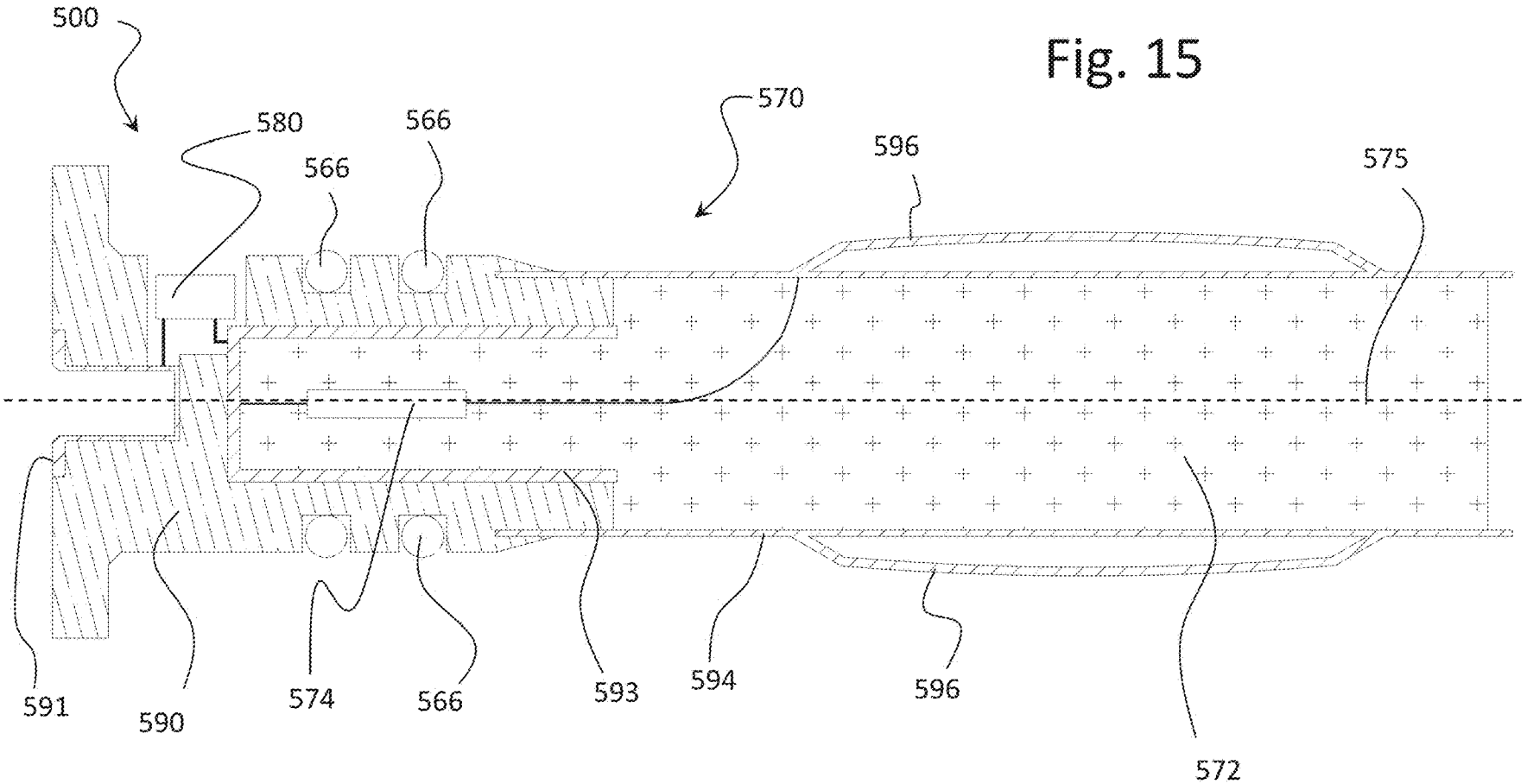
FIG. 15 is a further enlargement of the igniter of the embodiment shown in FIGS. 13 and 14.

Turning to a further embodiment of the present disclosure, FIGS. 13-15 illustrates a system 500 for setting a plug in a wellbore (e.g., setting plug 44 in the wellbore 14 shown in FIG. 1). System 500 generally includes a setting tool 510 and a setting tool initiator 540 coupled to the setting tool 510. System 500 may comprise additional equipment in other embodiments such as a plug (e.g., plug 44) and/or other equipment of a wellbore deployable tool string (e.g., tool string 32 shown in FIG. 1) not shown in FIGS. 13-15.

Setting tool 510 of system 500 generally includes a setting tool housing 512 and a piston 520 positioned within the setting tool housing 512 for axial or telescoping movement with respect to one another. Piston 520 defines an interior bore or opening that forms a combustion chamber 522 and receives a combustible element 530 configured, upon activation, to shift a plug from a first or run-in configuration that permits fluid flow around the plug within the wellbore and a second or set configuration that restricts fluid flow around the plug within the wellbore.

Setting tool initiator 540 of system 500 generally includes an initiator housing 542, a setting tool igniter switch 550, and an igniter 560. In this exemplary embodiment, a downhole end 543 of initiator housing 542 is connectable to an uphole end 574 of piston 520 and includes setting tool igniter switch 550 positioned within a central opening or passage 544 of initiator housing 542. Generally, igniter 560 is configured to ignite or activate the combustible element 530 of setting tool 510 upon receiving a predefined ignition signal from the igniter switch 550 to thereby actuate setting tool 510 (driving the piston 520 axially relative to the setting tool housing 510) and shift a corresponding plug coupled to setting tool 510 from the run-in configuration to the set configuration.

In this exemplary embodiment, igniter 560 generally includes an igniter housing 562 and an igniter assembly 570 coupled to the igniter housing 562 and located downhole from the igniter switch 550 in the wellbore upon deployment. Igniter assembly 570 is in signal communication with igniter switch 550 and is positioned in an igniter compartment 564 formed within the igniter housing 562 as shown particularly in FIGS. 14 and 15. In this exemplary embodiment, igniter assembly 570 is sealed within the igniter compartment 564 by one or more annular sealing members or elements 566 (e.g., O-rings or other elastomeric seals) of igniter 560 that are positioned in the igniter compartment 564 radially between the outer diameter or periphery of the igniter assembly 570 and the inner diameter or surface defining the igniter compartment 564. In this configuration, sealing elements 566 seal igniter switch 550 from igniter assembly 570 while also isolating the igniter switch 550 from the pressure and temperature created by the activation of igniter assembly 570 and combustible element 530. In this manner, igniter switch 550 may survive the activation of igniter assembly 570/combustible element 530 and the subsequent setting of the plug coupled therewith such that signal communication is preserved between the igniter switch 550 and a surface controller or control system (e.g., surface controller 13 shown in FIG. 1) of system 500 along a signal communication path 501 of system 500 extending therebetween following the setting of the plug.

In this exemplary embodiment, system 500 additionally includes a signal interrupter 580 interposed between the igniter switch 550 and igniter assembly 570 and in signal communication with both switch 550 and signal interrupter 580. Generally, signal interrupter 580 is configured to break the signal connection or connectivity between the igniter switch 550 and the igniter assembly 570 in response to signal interrupter 580 encountering a predefined tool or toolstring condition. The predefined toolstring condition comprises one or more predefined physical conditions encountered by a tool string (e.g., tool string 32 shown in FIG. 1) in a wellbore. In some embodiments, the toolstring condition comprises one or more physical conditions encountered by the signal interrupter 580 of a toolstring.

The predefined toolstring condition may vary in different embodiments. For example, including, for example, a threshold toolstring pressure, a threshold toolstring temperature, a threshold toolstring force (e.g., a linear force, a rotational force or torque), a threshold toolstring acceleration, (e.g., in terms of G-forces and in the form of vibration, shock, and the like) encountered by the tool string/signal interrupter 580. The predefined toolstring condition may correspond to anticipated conditions to be encountered by the signal interrupter 580 during the setting of the plug coupled to setting tool 510, such as a result of the activation of igniter 570 and/or combustible element 530. In other words, the toolstring condition may be generated through or in response to the setting of the plug coupled to setting tool 510 such as a rapid increase or spike in pressure, temperature, and/or vibration encountered by signal interrupter 580 in the wellbore. In this manner, signal interrupter 580 may act as a sensor configured to transition automatically from a first state (e.g., communicative-providing signal connectivity thereacross) to a second state (e.g., noncommunicative-preventing signal connectivity thereacross) in response to encountering the predefined toolstring condition without requiring destruction or physical damaging of the igniter switch 550 such that the igniter switch 550 may be reused in subsequent perforating operation or stage of a multi-stage perforating operation thereby minimizing the number of igniter switches 550 that must be acquired in order to perform a given perforating operation. Although signal interrupter 580 is shown as a separate component in FIGS. 13-15, in other embodiments, signal interrupter 580 may comprise a component or feature of the resistor 574.

In some embodiments, igniter switch 550, igniter assembly 570, and signal interrupter 580 comprise electrical equipment with signal communication path 501 comprising an electrical circuit extending between the surface control system and downhole equipment including, for example, setting tool 510 and setting tool initiator 540. In some embodiments, signal interrupter 580 comprises an electrical switch or circuit breaker configured to break the electrical circuit formed between igniter switch 550 and igniter assembly 570 upon encountering the predefined toolstring condition.

As shown particularly in FIG. 15, igniter assembly 570 has a central or longitudinal axis 575 and includes combustible element 572 and an activator in the form of a resistor 574 (e.g., a heat resistor) for selectably igniting or activating the combustible element 572 in response to the igniter assembly 570 receiving the ignition signal. Particularly, in this exemplary embodiment, resistor 574 is for rapidly heating within the combustible element 572 of the igniter assembly 570. The resistor 574 is an electrical element as known in the art heat up when sufficient electric power (carried by the ignition signal) is directed through resistor 574 to ignite the combustible element 572.

In this exemplary embodiment, igniter assembly 570 additionally includes an igniter bulkhead 590 and an igniter tube 594 that receives the combustible element 572 therein and is coupled to the igniter bulkhead 590. Particularly, igniter bulkhead 590 is located at a longitudinal first or uphole end of igniter assembly 570 with igniter tube 594 extending from bulkhead 590 to a longitudinal second or downhole end of igniter assembly 570. Igniter bulkhead 590 comprises materials configured to obstruct or minimize signal connectivity thereacross while igniter tube 594 may conversely comprise materials configured to enhance or maximize signal connectivity therethrough. For example, igniter bulkhead 590 may comprise an electrical resistor (e.g., comprising electrically resistive materials) while igniter tube 594 may comprise an electrical conductor (e.g., comprising electrically conductive materials).

Igniter assembly 570 comprises a first or uphole signal connector 591 and a second or downhole signal connector 593 each coupled to the igniter bulkhead 590. For example, signal connectors 591 and 593 may be arranged on opposing (e.g., uphole and downhole) ends of igniter bulkhead 590 for communicating signals (e.g., electrical signals) across the igniter bulkhead 590. Particularly, in this exemplary embodiment, signal interrupter 580 is connected between the pair of signal connectors 591 and 593 such that signal connectors 591 and 593 are in signal communication through the signal interrupter 580 when signal interrupter 580 is in the first state but signal connectors 591 and 593 are not in signal communication (e.g., signal connectivity between connectors 591 and 593 is severed or broken) when signal interrupter 580 is in the second state (e.g., due to igniter bulkhead 590 comprising signal connectivity minimizing materials). In this exemplary embodiment, signal interrupter 580 is coupled to igniter bulkhead 590 and is radially offset from the central axis 575 of igniter assembly 570.

In this exemplary embodiment, prior to activation of igniter assembly 570, signal communication path 501 of system 500 extends from the igniter switch 550 through an initiator signal connector 552 of setting tool initiator 540, through uphole connector 591 of igniter assembly 570, signal interrupter 580 and downhole signal connector 593, and to the resistor 574 encapsulated within the combustible element 572 of igniter assembly 570. From resistor 574, signal communication path 501 extends to the igniter tube 594 (e.g., via a signal conductor extending therebetween) and from the igniter tube 594 to the igniter housing 562 via one or more radial signal connectors (e.g., electrical ground springs) 596 of the igniter tube 594 that are biased (e.g., via a biasing element) radially outwards into contact with the inner diameter or surface defining igniter compartment 564 of igniter housing 562. In some embodiments, igniter housing 562 is grounded back to the surface along the periphery of the work string 30.

In some embodiments, signal interrupter 580 is configured to automatically shift from the first state to the second state and thereby disconnect signal connectors 591 and 593 (in-turn disconnecting igniter switch 550 from igniter assembly 570) upon the signal interrupter 580 encountering a predefined threshold wellbore temperature. In certain embodiments, the threshold wellbore temperature corresponds to a first temperature anticipated to be encountered by the signal interrupter 580 in response to activation of the combustible element 572 of igniter assembly 570. In other embodiments, the threshold wellbore temperature corresponds to a second temperature anticipated to be encountered by the signal interrupter 580 in response to activation of the combustible element 530 of setting tool 510 which may exceed the first temperature. In other words, the threshold wellbore temperature may, in some embodiments, be linked in some embodiments to activation of combustible element 572 whereby signal interrupter 580 is configured to shift from the first state to the second state in response to the activation of combustible element 572. Conversely, in other embodiments the threshold wellbore temperature may instead be linked to activation of combustible element 530 whereby signal interrupter 580 is configured to shift from the first state to the second state in response to the activation of combustible element 530 which follows the activation of combustible element 572 and generates significantly greater heat (and consequently greater wellbore temperatures) than the activation of combustible element 572.

It should be noted that igniter bulkhead 590 is preferably electrically non-conductive in some embodiments. However, an electric circuit is preferably arranged in some embodiments to extend around the igniter bulkhead 590 with a conductive electric first or lead-in connector 591 arranged to receive electric power and electric signals from the initiator signal connector 552. In certain embodiments, the electric lead-in connector 591 is electrically connected to signal interrupter 580 by known means including conventional wiring. Similarly, in certain embodiments, the signal interrupter 580 is electrically connected to the conductive electric pass-through connector 593 which is itself electrically connected to the heat resistor 574. In certain embodiments, resistor 574 is further electrically connected to the electrically conductive igniter tube 594 which is grounded to the igniter housing 562.

By shifting the signal interrupter 580 from the first state to the second state, the successful activation of combustible element 530/572 (depending on the configuration of the signal interrupter 580) may be confirmed at the surface such as at the surface control system via the change that occurs to signal communication path 501 as a result of the shifting of signal interrupter 580 from the first state to the second state. Particularly, shifting of the signal interrupter 580 from the first state to the second state disconnects at least some components of igniter assembly 570 (e.g., resistor 574) from signal communication path 501, which may be detected at the surface control system that is connected to the signal communication path 501. In addition, igniter switch 550 is protected from the effects of the activation of combustible element 530 and 572, and thus may be reused in future operations in subsequent wellbores.

Figure 16:
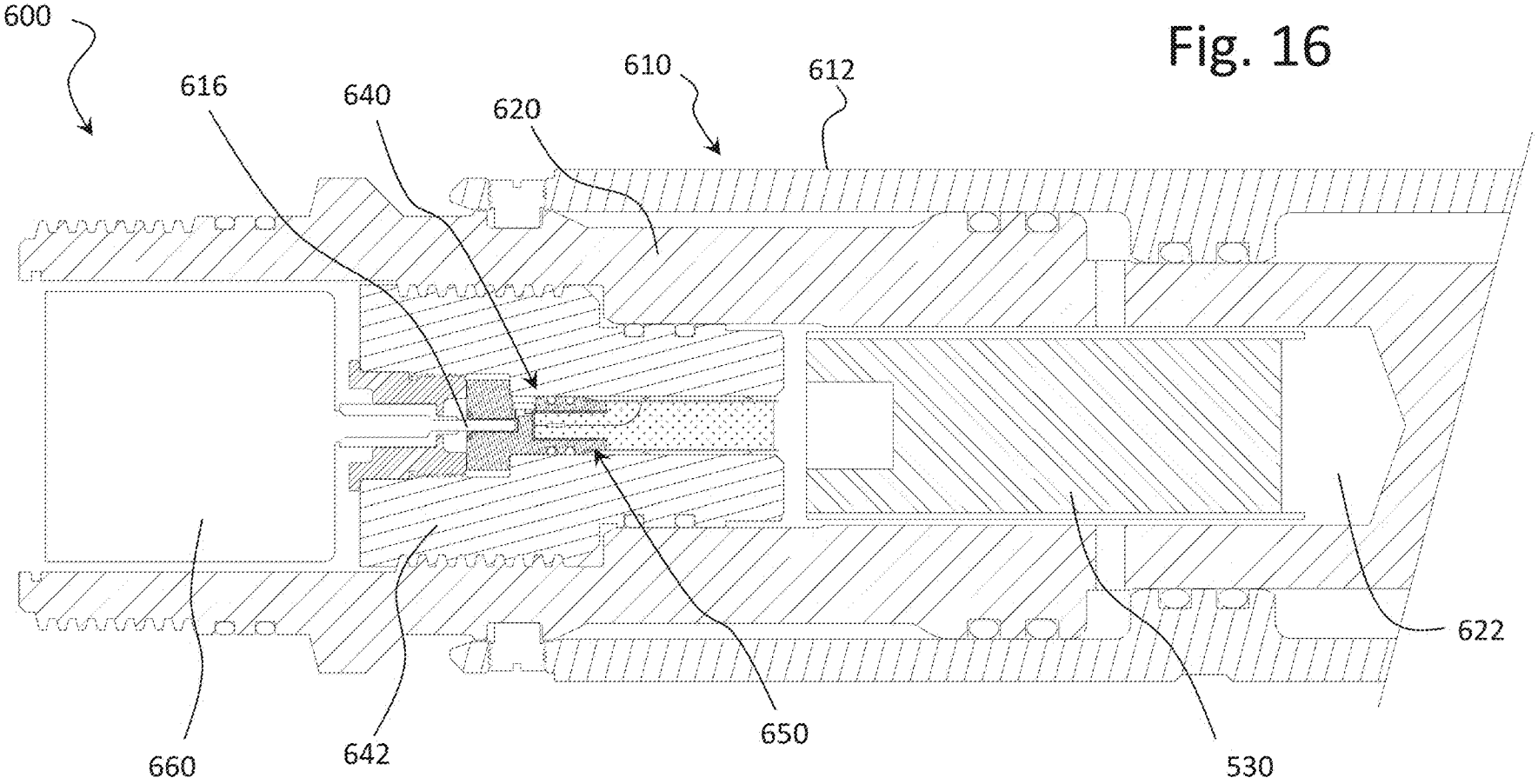
FIG. 16 is fragmentary elevation cross section of a further embodiment of the disclosure.

Turning to another, but similar, embodiment shown in FIG. 16, another system 600 for setting a plug in a wellbore (e.g., setting plug 44 in the wellbore 14 shown in FIG. 1). System 600 generally includes a setting tool 610 and a setting tool initiator 640 coupled to the setting tool 610. System 600 may comprise additional equipment in other embodiments such as a plug (e.g., plug 44) and/or other equipment of a wellbore deployable tool string (e.g., tool string 32 shown in FIG. 1) not shown in FIG. 16.

Setting tool 610 includes a setting tool housing 612 and a piston 620 positioned within the setting tool housing 612 for axial or telescoping movement with respect to one another. Piston 620 defines an interior bore or opening that forms a combustion chamber 622 and receives combustive element 530 configured, upon activation, to shift a plug coupled to setting tool 610 from a first or run-in configuration that permits fluid flow around the plug within the wellbore and a second or set configuration that restricts fluid flow around the plug within the wellbore.

In this exemplary embodiment, setting tool initiator 640 comprises an igniter housing 642, an igniter assembly 650 received in the igniter housing 642, and a setting tool igniter switch or switch pod 660. The igniter assembly 650 is connected to switch pod 660 by an igniter signal connector 616 positioned therebetween. In some embodiments, igniter assembly 650 is configured similarly as igniter assembly 570 shown in FIGS. 13-15. For example, igniter assembly 650 annular sealing elements (e.g., sealing elements 566 shown in FIG. 15) and a bulkhead (e.g., igniter bulkhead 590 shown in FIG. 15) to protect the switch pod 660 for possible re-use in a subsequent tool string.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

The invention claimed is:

1. A system for setting a plug in a wellbore, the system comprising:

a setting tool connectable to the plug and comprising a housing, a piston positioned at least partially within the housing, and a setting tool energetic element configured, upon activation, to displace the piston axially relative to the housing and shift the plug in the wellbore from a run-in configuration permitting fluid flow within the wellbore around the plug to a set configuration restricting fluid flow in the wellbore around the plug;

a surface control system configured to transmit an ignition signal;

an initiator comprising an igniter switch and an igniter assembly in signal communication with the igniter switch, wherein the igniter assembly includes an igniter energetic element configured to activate, in response to receiving the ignition signal from the surface control system, and thereby activate the setting tool energetic element to shift the plug from the run-in configuration to the set configuration; and an electrical circuit comprising the surface control system, the igniter switch, the igniter assembly, and a signal interrupter that is configured to disconnect the electrical circuit because of the initiator receiving the ignition signal from the surface control system whereby a surface indication is provided of the shifting of the plug to the set configuration.

2. The system according to claim 1, further comprising the plug connected to a downhole end of the setting tool.

3. The system according to claim 1, whereby the surface indication is indicative of the electrical circuit being in a disconnected state.

4. The system according to claim 1, wherein the signal interrupter comprises an electrical switch.

5. The system according to claim 1, wherein the signal interrupter comprises an electrical circuit breaker.

6. The system according to claim 1, wherein fluid communication is restricted between the signal interrupter and the igniter switch.

7. The system according to claim 1, further comprising a pressure bulkhead that separates the signal interrupter from the igniter switch.

8. The system according to claim 1, wherein the signal interrupter is external the igniter energetic element.

9. A system for setting a plug in a wellbore, the system comprising:

a setting tool connectable to the plug and comprising a housing, a piston positioned at least partially within the housing, and a setting tool energetic element configured, upon activation, to displace the piston axially relative to the housing and shift the plug in the wellbore from a run-in configuration permitting fluid flow within the wellbore around the plug to a set configuration restricting fluid flow in the wellbore around the plug;

a surface control system configured to transmit an ignition signal;

an initiator comprising a igniter switch and an igniter assembly in signal communication with the igniter switch, wherein the igniter assembly includes an igniter energetic element configured to activate, in response to receiving the ignition signal from the surface control system, and thereby activate the setting tool energetic element to shift the plug from the run-in configuration to the set configuration; and an electrical circuit comprising the surface control system, the igniter switch, the igniter assembly, and a signal interrupter that is fluidically isolated from the igniter switch and configured to disconnect the electrical circuit whereby a surface indication is provided of the shifting of the plug to the set configuration.

10. The system according to claim 9, further comprising the plug connected to a downhole end of the setting tool.

11. The system according to claim 9, whereby the surface indication corresponds to the electrical circuit being in a disconnected state.

12. The system according to claim 9, wherein the signal interrupter comprises an electrical switch.

13. The system according to claim 9, wherein the signal interrupter comprises an electrical circuit breaker.

14. The system according to claim 9, wherein the signal interrupter is external the igniter energetic element.

15. A method for setting a plug in a wellbore, the method comprising:

(a) deploying a tool string into a wellbore;

(b) transmitting an ignition signal from a surface control system along an electrical circuit to the tool string;

(c) receiving by an initiator of the tool string the ignition signal from the surface control system;

(d) activating an energetic element of the initiator in response to receiving the ignition signal to shift a plug of the tool string from a run-in configuration permitting fluid flow within the wellbore around the plug to a set configuration restricting fluid flow in the wellbore around the plug;

(e) disconnecting the electrical circuit by a signal interrupter of the electrical circuit because of the initiator receiving the ignition signal; and (f) providing by the surface control system a surface indication of the shifting of the plug to the set configuration in response to the signal interrupter disconnecting the electrical circuit.

16. The method according to claim 15, whereby the surface indication is indicative of the electrical circuit being in a disconnected state.

17. The method according to claim 15, wherein the signal interrupter comprises an electrical switch.

18. The method according to claim 15, wherein the signal interrupter comprises an electrical circuit breaker.

19. The method according to claim 15, wherein (e) comprises exposing the signal interrupter to combustion products generated by the energetic element.

20. The method according to claim 15, further comprising:

(g) preserving an electrical connection between an igniter switch of the initiator and the surface control system following (e).

* * * * *